US009052623B2

(12) United States Patent
Akutagawa et al.

(10) Patent No.: US 9,052,623 B2
(45) Date of Patent: Jun. 9, 2015

(54) TONER BINDER AND TONER COMPOSITION

(75) Inventors: Takashi Akutagawa, Kyoto (JP); Masakazu Iwata, Kyoto (JP); Masaru Honda, Kyoto (JP); Tomoyuki Ariyoshi, Kyoto (JP)

(73) Assignee: Sanyo Chemical Industries, Ltd., Kyoto (JP)

( * ) Notice: Subject to any disclaimer, the term of this patent is extended or adjusted under 35 U.S.C. 154(b) by 142 days.

(21) Appl. No.: 13/878,219

(22) PCT Filed: Oct. 6, 2011

(86) PCT No.: PCT/JP2011/073117

§ 371 (c)(1),
(2), (4) Date: Jul. 8, 2013

(87) PCT Pub. No.: WO2012/046811

PCT Pub. Date: Apr. 12, 2012

(65) Prior Publication Data

US 2013/0273469 A1 Oct. 17, 2013

(30) Foreign Application Priority Data

Oct. 6, 2010 (JP) ..... 2010-227012

(51) Int. Cl.
*G03G 9/087* (2006.01)

(52) U.S. Cl.
CPC ..... *G03G 9/08755* (2013.01); *G03G 9/08764* (2013.01); *G03G 9/08795* (2013.01); *G03G 9/08797* (2013.01)

(58) Field of Classification Search
CPC ..... G03G 9/08755; G03G 9/08764
USPC ..... 430/109.4, 109.3, 111.4
See application file for complete search history.

(56) References Cited

U.S. PATENT DOCUMENTS

| | | | | |
|---|---|---|---|---|
| 6,383,705 | B2 * | 5/2002 | Aoki et al. | 430/109.4 |
| 7,585,921 | B2 * | 9/2009 | Kishiki et al. | 430/109.4 |
| 7,951,518 | B2 * | 5/2011 | Ono et al. | 430/109.4 |
| 2002/0106573 | A1 | 8/2002 | Hamano et al. | |
| 2004/0229149 | A1 * | 11/2004 | Kadota et al. | 430/111.4 |
| 2006/0088779 | A1 * | 4/2006 | Sacripante et al. | 430/109.4 |
| 2008/0187854 | A1 | 8/2008 | Yoshida et al. | |

FOREIGN PATENT DOCUMENTS

| | | | |
|---|---|---|---|
| CN | 1742238 | A | 3/2006 |
| CN | 1804729 | A | 7/2006 |
| CN | 1894635 | A | 1/2007 |
| JP | 2000-075549 | A | 3/2000 |
| JP | 2005-077930 | A | 3/2005 |
| JP | 2008-191260 | | 8/2008 |
| JP | 2008-203779 | | 9/2008 |
| JP | 2009-237166 | | 10/2009 |
| WO | WO-2006/095901 | | 9/2006 |
| WO | WO-2009/122687 | A1 | 10/2009 |

OTHER PUBLICATIONS

International Search Report (English translation) mailed Nov. 8, 2011, in corresponding PCT Application No. PCT/JP2011/073117.
Office Action dated Feb. 4, 2015, issued for the Chinese patent application No. 201180048587.8 and English translation thereof.

* cited by examiner

*Primary Examiner* — Christopher Rodee
(74) *Attorney, Agent, or Firm* — Locke Lord LLP

(57) ABSTRACT

Provided is a toner binder which combines excellent low-temperature fixing properties and excellent hot-offset resistance (namely which permits a wide fixing-temperature range) and which exhibits excellent storage stability. The toner binder comprises (A) a polyester resin, (B) a specific crystalline resin and, if necessary, (C) a non-crystalline linear polyester resin. The polyester resin (A) comprises a carboxylic acid component (x) and a polyol component (y) as the essential constituent units, said component (x) comprising two or more kinds of dicarboxylic acids (x1) selected from among aromatic dicarboxylic acids and ester-forming derivatives thereof in a total amount of 80 mol % or more and further containing an at least trivalent polycarboxylic acid (x2) as another essential component, and said component (y) comprising a C2-10 aliphatic diol (y1) in an amount of 50 mol % or more. Further, the polyester resin (A) exhibits a storage modulus at 150° C. [G'(150)] of 2000 Pa or more, and the [G'(150)] and [G'(180)] (storage modulus at 180° C.) of the resin (A) satisfy a specific relationship.

16 Claims, No Drawings

TONER BINDER AND TONER COMPOSITION

CROSS-REFERENCE TO RELATED APPLICATIONS

This application is the national stage application pursuant to 35 U.S.C. §371 of PCT application PCT/JP2010/073117, filed Oct. 6, 2011, which claims priority to Japanese patent application No. 2010-227012, filed Oct. 6, 2010. The contents of these applications are incorporated herein by reference in their entirety.

TECHNICAL FIELD

The present invention relates to a toner binder comprising a polyester resin and a toner composition which are useful for dry toner to be used for the development of an electrostatic charge image or magnetic latent image in an electrophotographic process, an electrostatic recording process, an electrostatic printing process, and the like.

BACKGROUND ART

With respect to toner binders for electrophotography for use in a thermo-fixing system that is generally used as a fixing system for an image in a copying machine, a printer and the like, characteristics, such as preventing a toner from being fused to adhere to a hot roll even at a high fixing temperature (hot offset resistance), making a toner fixable even at a low fixing temperature (low-temperature fixing property) and storage stability, have been demanded.

Toner compositions that comprise a polyester-based toner binder and are superior in both of low-temperature fixing property and hot offset resistance have been known (see Patent Documents 1 and 2). In recent years, however, demands for storage stability and exhibiting both of low-temperature fixing property and hot offset resistance (a fixing temperature range) have become higher and higher, and the demands have not been satisfied sufficiently.

PRIOR ART DOCUMENTS

Patent Documents

Patent Document 1: JP-A-H12-75549
Patent Document 2: JP-A-2005-77930

DISCLOSURE OF THE INVENTION

Problems to be Solved by the Invention

An object of the present invention is to provide a toner binder that is superior in both of low-temperature fixing property and hot offset resistance (a fixing temperature range) as well as in storage stability.

Solutions to the Problems

In order to solve these problems, the present inventors have studied intensively, and thus have achieved the present invention.

That is, the present invention provides a toner binder comprising a polyester resin (A) comprising at least a carboxylic acid component (x) and a polyol component (y) as constituent units, the carboxylic acid component (x) containing 80% by mol or more in total of two or more dicarboxylic acids (x1) selected from among aromatic dicarboxylic acids and ester-forming derivatives thereof, and also containing at least a polycarboxylic acid having three or more carboxyl groups (x2), and the polyol component (y) containing 50% by mol or more of an aliphatic diol (y1) having 2 to 10 carbon atoms, wherein the polyester resin (A) has a storage modulus at 150° C. [G'(150)] of 2000 Pa or more, and [G'(150)] and a storage modulus at 180° C. [G'(180)] satisfy the formula (1) given below; a crystalline resin (B) that has a maximum peak temperature [Tb] of heat of melting of 40 to 100° C., a ratio [Tm/Tb] of a softening point [Tm] to [Tb] of 0.8 to 1.55, and a melt initiation temperature [X] being within the temperature range of (Tb±30)° C., wherein a storage modulus G'(Tb+20) at (Tb+20)° C. as well as a loss modulus G"(X+20) at (X+20)° C. and a loss modulus G"(X) at X° C. each satisfy Condition 1 and Condition 2 defined below; and, if necessary, a non-crystalline linear polyester resin (C); and a toner composition comprising this toner binder, a colorant, and, if necessary, one or more additives selected from among a release agent, a charge controlling agent, and a fluidizer:

$$[G'(150)]/[G'(180)] \leq 15 \quad \text{formula (1)}$$

$$G'(Tb+20)=50 \text{ to } 1\times10^6 \text{ Pa} \quad \text{[Condition 1]}$$

$$|\log G''(X+20)-\log G''(X)|>2.0. \quad \text{[Condition 2]}$$

Advantages of the Invention

The present invention has made it possible to provide a toner binder and a toner that are superior in both of low-temperature fixing property and hot offset resistance (a fixing temperature range) as well as in storage stability.

MODE FOR CARRYING OUT THE INVENTION

The present invention will be described in detail below.

The toner binder of the present invention comprises a polyester resin (A) and a crystalline resin (B).

The polyester resin (A) is a polyester resin that contains at least a carboxylic acid component (x) and a polyol component (y) as constituent units, and from the viewpoint of achieving both of low-temperature fixing property and hot offset resistance (a fixing temperature range), the polyester resin (A) has the carboxylic acid component (x) which contains 80% by mol or more in the total of two or more dicarboxylic acids (x1) selected from among aromatic dicarboxylic acids and ester-forming derivatives thereof, and also contains at least a polycarboxylic acid having three or more carboxyl groups (x2) (hereinafter also referred to as trivalent or more polycarboxylic acid(s) (x2)), and the polyol component (y) which contains 50% by mol or more of an aliphatic diol (y1) having 2 to 10 carbon atoms, as constituent units.

Examples of the two or more dicarboxylic acids (x1) selected from among aromatic dicarboxylic acids and ester-forming derivatives thereof include two or more selected from among aromatic dicarboxylic acids having 8 to 36 carbon atoms (phthalic acid, isophthalic acid, terephthalic acid, naphthalene dicarboxylic acid, and the like) and ester-forming derivatives thereof; and the like.

Examples of the ester-forming derivatives include acid anhydrides, alkyl (with 1 to 24 carbon atoms: methyl, ethyl, butyl, stearyl, or the like, preferably with 1 to 4 carbon atoms) esters, partial alkyl (the same as described above) esters, and the like. The same is true for ester-forming derivatives to be described below.

In the present invention, with respect to the two or more dicarboxylic acids (x1) selected from among aromatic dicarboxylic acids and ester-forming derivatives thereof, an aromatic dicarboxylic acid and ester-forming derivatives of the same dicarboxylic acid are defined as one kind.

Among these (x1), from the viewpoint of achieving both of low-temperature fixing property and hot offset resistance, two or more selected from the following (1) to (3) are preferable:

(1) Terephthalic acid and/or ester-forming derivatives thereof, (2) Isophthalic acid and/or ester-forming derivatives thereof, and (3) Phthalic acid and/or ester-forming derivatives thereof.

Preferable combinations are (1) and (2), as well as (1) and (3), and in more preferable combinations, the weight ratio of (1) to (2), that is, (1)/(2) is set to 3/7 to 8/2 (particularly 5/5 to 7/3), and the weight ratio of (1) to (3), that is, (1)/(3) is set to 3/7 to 8/2.

Among the carboxylic acid components (x), examples of carboxylic acid components other than dicarboxylic acid (x1) include dicarboxylic acids other than the (x1), trivalent or more polycarboxylic acids (x2), aromatic monocarboxylic acids (x3), and the like.

Among the carboxylic acid components (x), examples of dicarboxylic acids other than the (x1) include alkane dicarboxylic acids having 4 to 36 carbon atoms (e.g., succinic acid, adipic acid, and sebacic acid); alicyclic dicarboxylic acids having 6 to 40 carbon atoms [e.g., dimer acids (dimerized linoleic acid)]; alkene dicarboxylic acids having 4 to 36 carbon atoms (e.g., alkenyl succinic acids such as dodecenyl succinic acid, maleic acid, fumaric acid, citraconic acid, and mesaconic acid), and ester-forming derivatives; and the like.

Among them, alkane dicarboxylic acids having 4 to 20 carbon atoms, alkene dicarboxylic acids having 4 to 36 carbon atoms, and ester-forming derivatives thereof are preferable, and succinic acid, adipic acid, maleic acid, fumaric acid, and/or ester-forming derivatives thereof are more preferable.

Examples of the trivalent or more (preferably, tri- to hexavalent) polycarboxylic acids (x2) include aromatic carboxylic acids having 9 to 20 carbon atoms (trimellitic acid, pyromellitic acid, and the like), aliphatic (including alicyclic) carboxylic acids having 6 to 36 carbon atoms (hexane tricarboxylic acids, decane tricarboxylic acids, and the like), and ester-forming derivatives thereof.

Among them, trimellitic acid, pyromellitic aid and ester-forming derivatives thereof are preferable.

Examples of the monocarboxylic acids (x3) include aliphatic (including alicyclic) monocarboxylic acids (x31) having 1 to 30 carbon atoms and aromatic monocarboxylic acids (x32) having 7 to 36 carbon atoms.

Examples of the aliphatic (including alicyclic) monocarboxylic acids (x31) having 1 to 30 carbon atoms include alkane monocarboxylic acids having 1 to 30 (preferably 1 to 24) carbon atoms (formic acid, acetic acid, propionic acid, butanoic acid, isobutanoic acid, caprylic acid, capric acid, lauric acid, myristylic acid, palmitic acid, stearic acid, behenic acid, cerotic acid, montanoic acid, melissic acid, and the like), alkene monocarboxylic acids having 3 to 30 (preferably 3 to 24) carbon atoms (acrylic acid, methacrylic acid, oleic acid, linoleic acid, and the like), and the like.

Examples of the aromatic monocarboxylic acids (x32) having 7 to 36 carbon atoms include benzoic acid having 7 to 14 carbon atoms and derivatives thereof (derivatives refer to those having a structure in which one or more hydrogen atoms in the aromatic ring of benzoic acid is substituted by an organic group having 1 to 7 carbon atoms; e.g., benzoic acid, 4-phenylbenzoic acid, para-tert-butylbenzoic acid, toluic acid, ortho-benzoyl benzoic acid, and naphthoic acid), derivatives of acetic acid having an aromatic substituent having 8 to 14 carbon atoms (derivatives refer to those having a structure in which one or more hydrogen atoms other than those included in a carboxylic group of acetic acid are substituted by an aromatic group having 6 to 12 carbon atoms; e.g., diphenyl acetic acid, phenoxy acetic acid, and α-phenoxypropionic acid), and the like, and two or more of them may be used in combination. Among them, benzoic acids having 7 to 14 carbon atoms and derivatives thereof are preferable, and benzoic acid is more preferable. In the case where the (x32) is used, a superior anti-blocking property can be obtained when used for a toner.

The amount of the dicarboxylic acid (x1) in the carboxylic acid component (x) is preferably set to 80% by mol or more, preferably 83 to 98% by mol, and more preferably 85 to 95% by mol.

Moreover, the amount of the polycarboxylic acid (x2) in the (x) is preferably set to 20% by mol or less, more preferably 1 to 15% by mol, and particularly preferably 2 to 12% by mol.

Furthermore, the amount of the aromatic monocarboxylic acid (x32) in the (x) is preferably set to 10% by mol or less, more preferably 0.1 to 9.5% by mol, and particularly preferably 0.5 to 9% by mol.

Examples of the aliphatic diol (y1) having 2 to 10 carbon atoms to be used in the polyol component (y) include alkylene glycols having 2 to 10 carbon atoms (ethylene glycol, 1,2-propylene glycol, 1,3-propylene glycol, 1,4-butane diol, neopentyl glycol, 1,6-hexane diol, 1,9-nonane diol, and 1,10-decane diol); alkylene ether glycols having 4 to 10 carbon atoms (diethylene glycol, triethylene glycol, dipropylene glycol, and the like); and the like.

Among these (y1), from the viewpoint of achieving both of low-temperature fixing property and hot offset resistance, non-branched aliphatic diols having a primary hydroxyl group at the terminal of a molecule (ethylene glycol, 1,3-propylene glycol, 1,4-butane diol, 1,6-hexane diol, 1,9-nonane diol, and 1,10-decane diol), and neopentyl glycol are preferable.

From the viewpoint of storage stability, ethylene glycol, 1,3-propylene glycol and 1,4-butane diol are more preferable, and ethylene glycol is particularly preferable.

Among the polyol components (y), examples of polyol components other than the aliphatic diol (y1) include diols other than the (y1) and trihydric or more polyols.

Among the polyol components (y), examples of diols other than the (y1) include alkylene glycols having 11 to 36 carbon atoms (1,12-dodecane diol and the like); alkylene ether glycols having 11 to 36 carbon atoms (polyethylene glycol, polypropylene glycol, polytetramethylene ether glycol, and the like); alicyclic diols having 6 to 36 carbon atoms (1,4-cyclohexane dimethanol, hydrogenated bisphenol A, and the like); (poly)oxyalkylene ethers of the above-mentioned alicyclic diols (alkylene group has 2 to 4 carbon atoms (oxyethylene, oxypropylene, and the like), the same is true for a polyoxyalkylene group to be described later) [having 1 to 30 oxyalkylene units (hereinafter, abbreviated as "AO unit")]; polyoxyalkylene ethers (having 2 to 30 AO units) of dihydric phenols [(monocyclic dihydric phenols (e.g., hydroquinone), and bisphenols (bisphenol A, bisphenol F, bisphenol S, and the like)]; and the like.

Among them, polyoxyalkylene ethers (having 2 to 30 AO units) of bisphenols are preferable.

Examples of the trihydric or more (preferably tri- to octahydric) polyols include tri- to octahydric or more aliphatic polyhydric alcohols having 3 to 36 carbon atoms (alkane polyols and intramolecular or intermolecular dehydrates thereof, e.g., glycerin, trimethylolethane, trimethylolpropane, pentaerythritol, sorbitol, sorbitan, polyglycerin, and dipentaerythritol; sugars and derivatives thereof, e.g., saccharose, and methylglucoside); (poly)oxyalkylene ethers (having 1 to 30 AO units) of the above-mentioned aliphatic polyhydric alcohols; (poly)oxyalkylene ethers (having 2 to 30 AO units) of trisphenols (trisphenol PA and the like); polyoxyalkylene ethers (having 2 to 30 AO units) of novolak resins (phenol novolak, cresol novolak, and the like, average degree of polymerization: 3 to 60), and the like.

Among them, tri- to octahydric or more aliphatic polyhydric alcohols, and polyoxyalkylene ethers (having 2 to 30 AO units) of novolak resins are preferable, and polyoxyalkylene ethers (having 2 to 30 AO units) of novolak resins are particularly preferable.

The amount of the aliphatic diol (y1) having 2 to 10 carbon atoms in the polyol component (y) [except for that diluted out from the system during a polycondensation reaction, the same is true for the following description] is set to 50% by mole or more, preferably 80% by mole or more, and more preferably 85% by mole or more.

The polyester resin (A) in the present invention can be produced by using the same method as a usual polyester producing method. For example, the production can be carried out by allowing the carboxylic acid component (x) and the polyol component (y) to react with each other under an inert gas (nitrogen gas or the like) atmosphere at a reaction temperature of preferably 150 to 280° C., more preferably 170 to 260° C., and particularly preferably 190 to 240° C. Moreover, from the viewpoint of ensuring the polycondensation reaction, the reaction time is preferably set to 30 minutes or more, in particular, 2 to 40 hours. It is effective to reduce the pressure so as to improve the reaction rate in the final stage of the reaction.

The reaction ratio of the polyol component (y) to the polycarboxylic acid component (x) is preferably set to 2/1 to 1/2, more preferably 1.5/1 to 1/1.3, and particularly preferably 1.3/1 to 1/1.2, expressed by an equivalent ratio [OH]/[COOH] of a hydroxyl group and a carboxylic group.

In this case, an esterification catalyst may be used, if necessary. Examples of the esterification catalyst include tin-containing catalysts (e.g., dibutyl tin oxide), antimony trioxide, titanium-containing catalysts [e.g., titanium alkoxide, potassium titanate oxalate, titanium terephthalate, catalysts described in JP-A-2006-243715 [titanium dihydroxybis(triethanol aminate), titanium monohydroxytris(triethanol aminate), and intramolecular polycondensation products thereof], catalysts described in JP-A-2007-11307 (titanium tributoxyterephthalate, titanium triisopropoxyterephthalate, and titanium diisopropoxyditerephthalate, and the like)], zirconium-containing catalysts (e.g., zirconyl acetate), zinc acetate, and the like. Among them, titanium-containing catalysts are preferable.

The polyester resin (A) to be used in the present invention may be a modified polyester resin (A1) having a urethane group and a urea group, the (A1) further containing a polyisocyanate (i) as well as a polyamine (j) and/or water, in addition to the carboxylic acid component (x) and the polyol component (y). Therefore, a combination of the polyisocyanate (i) and the polyamine (j), a combination of the polyisocyanate (i) and water, and a combination of the polyisocyanate (i), the polyamine (j), and water are available.

The modified polyester (A1) is preferable from the viewpoint of ensuring a toner fixing temperature range.

Examples of the polyisocyanate (i) include aromatic polyisocyanates having 6 to 20 carbon atoms (excluding carbon atoms in NCO group, the same is true for the following description), aliphatic polyisocyanates having 2 to 18 carbon atoms, alicyclic polyisocyanates having 4 to 15 carbon atoms, aromatic aliphatic polyisocyanates having 8 to 15 carbon atoms, and modified products of these polyisocyanates (modified products containing a urethane group, a carbodiimide group, an allophanate group, a urea group, a biuret group, a urethodione group, a urethoimine group, an isocyanurate group, an oxazolidone group, and the like); and mixtures of two or more thereof.

Specific examples of the aromatic polyisocyanates include, 1,3- and/or 1,4-phenylene isocyanate, 2,4- and/or 2,6-tolylene diisocyanate (TDI), crude TDI, 2,4'- and/or 4,4'-diphenylmethane diisocyanate (MDI), crude MDI, and 1,5-naphthylene diisocyanate, 4,4',4"-triphenylmethane triisocyanate, and the like.

Specific examples of the aliphatic polyisocyanates include ethylene diisocyanate, tetramethylene diisocyanate, hexamethylenediisocyanate (HDI), dodecamethylene diisocyanate, 1,6,11-undecane triisocyanate, lysine diisocyanate, 2,6-diisocyanatomethyl caproate, bis(2-isocyanatoethyl) fumarate, and the like.

Specific examples of the alicyclic polyisocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate, and the like.

Specific examples of the aromatic aliphatic polyisocyanates include m- and/or p-xylylene diisocyanate (XDI), α,α,α',α'-tetramethylxylylene diisocyanate (TMXDI), and the like.

Among them, aromatic polyisocyanates having 6 to 15 carbon atoms, aliphatic polyisocyanates having 4 to 12 carbon atoms and alicyclic polyisocyanates having 4 to 15 carbon atoms are preferable, and TDI, MDI, HDI, hydrogenated MDI, and IPDI are particularly preferable.

Examples of the polyamine (j) include aliphatic diamines (C2 to C18), aromatic diamines (C6 to C20), and the like, and mixtures of two or more thereof.

Examples of the aliphatic diamines (C2 to C18) include:

[1] aliphatic diamines {C2 to C6 alkylene diamines (ethylenediamine, propylenediamine, trimethylenediamine, tetramethylenediamine, hexamethylenediamine, and the like), polyalkylene (C2 to C6) diamines [diethylenetriamine, iminobispropylamine, bis(hexamethylene)triamine, triethylenetetramine, tetraethylenepentamine, pentaethylenehexamine, and the like]};

[2] alkyl (C1 to C4) or hydroxyalkyl (C2 to C4) substituted compounds thereof [dialkyl (C1 to C3) aminopropylamine, trimethylhexamethylenediamine, aminoethylethanolamine, 2,5-dimethyl-2,5-hexamethylenediamine, methyliminobispropylamine, and the like];

[3] alicyclic- or heterocyclic-ring containing aliphatic diamines {alicyclic diamines (C4 to C15) [1,3-d]aminocyclohexane, isophoronediamine, menthenediamine, 4,4'-methylenedicyclohexanediamine (hydrogenated methylene dianiline), and the like], heterocyclic diamines (C4 to C15) [piperazine, N-aminoethylpiperazine, 1,4-diaminoethylpiperazine, 3,9-bis(3-aminopropyl)-2,4,8,10-tetraoxaspiro[5,5]undecane, and the like];

[4] aromatic ring-containing aliphatic amines (C8 to C15) (xylylenediamine, tetrachloro-p-xylylenediamine, and the like); and the like.

Examples of the aromatic diamines (C6 to C20) include:

[1] unsubstituted aromatic diamines [1,2-, 1,3- and 1,4-phenylenediamine, 2,4'- and 4,4'-diphenylmethanediamine, crude diphenylmethanediamine (polyphenyl polymethylene polyamine), diaminodiphenylsulfone, benzidine, thiodianiline, 2,6-diaminopyridine, m-aminobenzylamine, triphenylmethane-4,4',4"-triamine, naphthylene diamine, and the like;

[2] aromatic diamines having a nuclear substitutive alkyl group [C1 to C4 alkyl groups such as a methyl group, an ethyl group, a n-propyl and an i-propyl groups, and a butyl group], for example, 2,4- and 2,6-tolylenediamines, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 2,3-dimethyl-1,4-diaminonaphthalene, 4,4'-diamino-3,3'-dimethyldiphenylmethane, and the like], and mixtures of these isomers at various ratios;

[3] aromatic diamines having a nuclear substitutive electron attractive group (halogen groups such as Cl, Br, I, and F groups; alkoxy groups such as methoxy and ethoxy groups; a nitro group, and the like) [methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, and the like]; and

[4] aromatic diamines having a secondary amino group [those in which a part of or all of —$NH_2$— of the above-mentioned aromatic diamines [1] to [3] is substituted with —NH—R' (R' is an alkyl group, e.g., a lower alkyl group such as a methyl or ethyl group)][4,4'-di(methylamino) diphenylmethane, 1-methyl-2-methylamino-4-aminobenzene, and the like].

In addition to these, examples of the polyamine (j) include polyamide polyamines [low molecular-weight polyamide polyamines obtained by condensation of a dicarboxylic acid (dimer acid, or the like) and excessive (2 mol or more per 1 mol of a carboxylic acid) polyamines (the above-mentioned alkylenediamine, polyalkylene polyamine, and the like)], and polyether polyamines [hydrides of cyanoethylated polyether polyols (polyalkylene glycol, and the like)].

With respect to the concentration of urethane and urea groups contained in the modified polyester resin (A1), from the view point of setting both of G' 180 and Eta[Tg+40] to be described later to preferable ranges, the total amount of the polyisocyanate (i) and polyamine (j) and water to be reacted with the (i), which are used as raw materials of the (A1), based on the total weight of the (A1) [that is, the total content of the (i) and (j) as the constituent units in the (A1) and water to be reacted with the (i): calculation value] is preferably set to 55% by weight or less, more preferably 0.1 to 50% by weight, and particularly preferably 0.3 to 35% by weight.

From the viewpoint of G'(180), the mole ratio of the urethane to urea groups introduced is preferably set to urethane group/urea group=50/50 to 95/5, more preferably 55/45 to 90/10.

The above-mentioned mole ratio is determined by the calculation of the ratio of mole number of urethane groups (—NHCOO—) to mole number of urea groups (—NHCONH—) contained in the (A1), based upon the weights of the polyisocyanate (i), polyamine (j) and water to be reacted with the (i) that have been used upon producing the modified polyester resin (A1).

The method for producing the modified polyester resin (A1) is not particularly limited, and a method including any one of the following three methods is preferable.

Production method [1]: a method that includes allowing a solution of a polyester resin (a) having a hydroxyl group, obtained by polycondensing a carboxylic acid component (x) and a polyol component (y), in an organic solvent (S) to react with a polyisocyanate (i), and then allowing a reaction product containing an unreacted isocyanate to react with a polyamine (j), so that a modified polyester resin (A1) is produced.

Production method [2]: a method that includes allowing a polyester resin (a) having a hydroxyl group, obtained by polycondensing a carboxylic acid component (x) and a polyol component (y), in its liquid state to react with a polyisocyanate (i), and then allowing a reaction product containing an unreacted isocyanate to react with a polyamine (j), so that a modified polyester resin (A1) is produced.

Production method [3]: a method that includes allowing a polyisocyanate (i) and a polyamine (j) to react with each other at an equivalent ratio of 1.5/1 to 3/1=[isocyanate groups in the (i)]/[amino groups in the (j)], and then allowing a polyol component (y) containing a modified polyol (y*) obtained by reacting a reaction product containing an unreacted isocyanate group with the polyol component (y) to be polycondensed with a carboxylic component (x), so that a modified polyester resin (A1) is produced.

The acid value of the polyester resin (A) is preferably 0 to 100 (mgKOH/g, the same is true for the following description). If the acid value is 100 or less, the electrostatic characteristic achieved when used in toner is not lowered.

In the case of the modified polyester resin (A1), the acid value is more preferably 0 to 80, and particularly preferably 0 to 60. In the case of a polyester resin (A) other than the (A1), it is more preferably 4 to 80, and particularly preferably 10 to 60 from the viewpoint of static electricity quantity.

The hydroxyl value of the (A) is preferably 0 to 100 (mgKOH/g, the same is true for the following description), more preferably 0 to 80, and particularly preferably 0 to 50. If the hydroxyl value is 100 or less, the hot offset resistance achieved when used as a toner becomes more favorable.

In the present invention, the acid value and hydroxyl value of the polyester resin are measured by using a method determined by JIS K0070 (issued in 1992).

In addition, in the case where a sample containing a solvent-insoluble matter caused by crosslinking, those obtained after melt-kneaded are used as a sample by using the following method.

Kneading apparatus: Labo plastomill MODEL 4M150 manufactured by Toyo Seiki Seisaku-sho, Ltd.

Kneading conditions: 30 minutes at 130° C., 70 rpm

The peak top molecular weight (hereinafter, described as Mp) of a tetrahydrofuran (THF)-soluble matter of the polyester resin (A) is preferably in a range of 2000 to 20000, more preferably 3000 to 10500, and particularly preferably 4000 to 9000, from the viewpoints of achieving both of heat resistant storage stability and low-temperature fixing property of the toner.

In the present invention, the molecular weight [Mp, number-average molecular weight (Mn) and weight average molecular weight (Mw)] of the resin is measured by gel permeation chromatography (GPC) under the following conditions.

Apparatus (one example): HLC-8120 manufactured by Tosoh Corporation

Column (one example): TSK GEL GMH6 two columns [manufactured by Tosoh Corporation]

Measurement temperature: 40° C.

Sample solution: 0.25% by weight solution in THF (tetrahydrofuran)

Solution injection amount: 100 μl

Detecting apparatus: Refraction index detector

Reference substance: Standard polystyrenes produced by Tosoh Corporation (TSK standard POLYSTYRENE) 12 points (molecular weights 500, 1050, 2800, 5970, 9100, 18100, 37900, 96400, 190000, 355000, 1090000 and 2890000)

A molecular weight showing the maximum peak height on the chromatogram obtained is referred to as the peak top molecular weight (Mp). Moreover, the measurement of the molecular weight is carried out through a process in which a polyester resin is dissolved in THF and an insoluble matter is filtered and separated by a glass filter, so that the resultant is used as a sample solution.

The glass transition temperature (Tg) of the polyester resin (A) to be used in the present invention is preferably 30 to 75° C., more preferably 40 to 72° C., and particularly preferably 50 to 70° C. from the viewpoints of fixing property, storage stability, and durability.

In this case, in the above description and the following description, Tg is measured by using DSC 20 and SSC/580 manufactured by Seiko Instruments Inc. in accordance with a method (DSC method) defined by ASTM D3418-82.

In the case where the (A) is a resin other than the modified polyester resin (A1), the softening point [Tm] of the (A) measured by a flow tester is preferably 120 to 170° C., more preferably 125 to 160° C., and particularly preferably 130 to 150° C. Moreover, the Tm of the (A1) is preferably 120 to 230° C., more preferably 123 to 225° C., and particularly preferably 125 to 220° C.

This range makes it possible to achieve both of superior hot offset resistance and low-temperature fixing property. In the present invention, the Tm is measured by using the following method.

<Softening Point [Tm]>

Using a constant-load orifice-type flow tester such as Koka flow tester {e.g., CFT-500D manufactured by SHIMADZU CORPORATION}, 1 g of a measurement sample is subjected to a load of 1.96 MPa by a plunger, while it is heated at a temperature rising rate of 6° C./minute, and extruded through a nozzle having a diameter of 1 mm and a length of 1 mm so that a graph of "an amount of the plunger descent (flow value)" and "a temperature" is drawn. The temperature corresponding to ½of the maximum value of the amount of the plunger descent is read from the graph, and the value (the temperature at which a half of the measurement sample has flowed out) is defined as a softening point [Tm].

From the viewpoint of the hot offset resistance when used as a toner, the polyester resin (A) to be used in the present invention preferably has a storage modulus (Pa) at 150° C. [also described as G'(150) herein] of 2000 Pa or more, and G'(150) and the storage modulus (Pa) at 180° C. [also described as G'(180) herein] need to satisfy the following formula (1), preferably the following formula (1'), and more preferably the following formula (1").

$$[G'(150)]/[G'(180)] \leq 15 \quad \text{formula (1)}$$

$$[G'(150)]/[G'(180)] \leq 14 \quad \text{formula (1')}$$

$$[G'(150)]/[G'(180)] \leq 13 \quad \text{formula (1")}$$

In the case where G'(150) and G'(180) satisfy the formula (1), it is considered that the viscosity does not become too low in a practical application range even at a high temperature area so that superior hot offset resistance is achieved when used as a toner.

In an attempt to adjust the storage modulus (G') of the polyester resin (A), for example, in an attempt to decrease G'(150)/G'(180), this attempt can be achieved, for example by increasing the Tm of the polyester resin (A), by increasing the ratio of trivalent or more constituent components so as to increase the number of cross-linking points, by increasing the molecular weight, by making the Tg higher, or the like.

In the present invention, the storage modulus (G') of a polyester resin is measured by using the following viscoelasticity measuring apparatus.

Apparatus: ARES-24A (manufactured by Rheometric Co., Ltd.)

Jig: 25 mm Parallel plate

Frequency: 1 Hz

Distortion rate: 5%

Temperature rising rate: 5° C./minute

From the viewpoint of low-temperature fixing property when used as a toner, the viscosity (Pa·s) at Tg+40° C. (described also as Eta[Tg+40] herein) of the polyester resin (A) preferably satisfies the following formula (2), more preferably the following formula (2'), and most preferably the following formula (2").

$$Eta[Tg+40] \leq 7\times10^5 \quad \text{formula (2)}$$

$$Eta[Tg+40] \leq 6\times10^5 \quad \text{formula (2')}$$

$$Eta[Tg+40] \leq 5\times10^5 \quad \text{formula (2")}$$

When Eta[Tg+40] satisfies the formula (2), the viscosity at a low-temperature becomes smaller, making it possible to provide a superior low-temperature fixing property when used as a toner.

In an attempt to adjust the viscosity Eta of the polyester resin (A), for example, in the case of making Eta[Tg+40] smaller, the Tm of the polyester resin (A) may be lowered, the Mp thereof may be made smaller, or the like.

In the present invention, the viscosity Eta of the polyester resin is measured by using the following viscoelasticity measuring apparatus.

Apparatus: ARES-24A (manufactured by Rheometric Co., Ltd.)

Jig: 8 mm Parallel plate

Frequency: 1 Hz

Distortion rate: 5%

Temperature rising rate: 3° C./minute

The toner binder of the present invention comprises a polyester resin (A) and a crystalline resin (B).

In the present invention, the term "crystalline" indicates that the ratio [Tm/Tb] of the softening point [Tm] to the maximum peak temperature [Tb] of heat of melting is 0.8 to 1.55, and a clear endothermic peak rather than a stepwise endothermic change is observed in differential scanning calorimetry (DSC). The term "noncrystalline" indicates that the ratio [Tm/Tb] of the softening point to the maximum peak temperature of heat of melting is greater than 1.55.

Even if the resin is a block polymer of a crystalline resin and a noncrystalline resin, it is regarded as a crystalline resin as far as a clear endothermic peak is observed in differential scanning calorimetry (DSC) and the ratio [Tm/Tb] of the softening point [Tm] to the maximum peak temperature [Tb] of heat of melting is ranging from 0.8 to 1.55.

From the viewpoint of heat resistant storage property, the crystalline resin (B) has a maximum peak temperature [Tb] of heat of melting ranging from 40 to 100° C., preferably from 45 to 80° C., and more preferably from 50 to 72° C.

The crystalline resin (B) has a ratio [Tm/Tb] of the softening point [Tm] to the maximum peak temperature [Tb] of heat of melting of 0.8 to 1.55 as described above, and when the ratio is outside this range, an image quality is likely to be lowered. It is preferably 0.85 to 1.2, and more preferably 0.9 to 1.15.

For the crystalline resin (B), the maximum peak temperature [Tb] of heat of melting is a value measured as follows.

<Maximum Peak Temperature [Tb] of Heat of Melting>

A differential scanning calorimeter (DSC) {e.g., DSC210 manufactured by Seiko Instruments Inc.} is used for measurement.

A sample to be subjected to measurement of the [Tb] is, in a pretreatment, melted at 130° C., and allowed to cool from 130° C. to 70° C. at a rate of 1.0° C./minute, and allowed to cool from 70° C. to 10° C. at a rate of 0.5° C./minute. An endothermic or exothermic change is measured through DSC by elevating the temperature to 180° C. at a temperature rising rate of 20° C./minute, and a graph of "an absorbed or released heat" and "a temperature" is drawn, and the endothermic peak temperature within the range of 20° C. to 100° C. observed is defined as Tb'. When there are a plurality of peaks, the temperature of the peak at which the absorbed heat is greatest is defined as Tb'. Finally, the sample is stored at (Tb'−10)° C. for 6 hours, and then stored at (Tb'−15)° C. for 6 hours.

Next, after cooling the above sample to 0° C. at a temperature decreasing rate of 10° C./minute, and an endothermic or exothermic change is measured through DSC by rising the temperature at a temperature rising rate of 20° C./minute, and a graph is drawn similarly. The temperature that corresponds to the maximum peak of endothermic heat is defined as a maximum peak temperature [Tb] of heat of melting.

With respect to the viscoelasticity characteristics of the crystalline resin (B), the storage modulus G' at (Tb+20)° C. (Tb is the maximum peak temperature of heat of melting) falls within the range of 50 to $1\times10^6$ Pa [Condition 1], and preferably within the range of 100 to $5\times10^5$ Pa.

If G' at (Tb+20)° C. is less than 50 Pa, hot offset occurs even at the time of fixation at low temperature, and a fixing temperature range becomes narrowed. If it exceeds $1\times10^6$ Pa, viscosity that enables fixing at a low temperature is difficult to be obtained, so that a fixing property at low temperature is impaired.

In the present invention, the dynamic viscoelasticity measurement values (storage modulus G', loss modulus G") are measured using a dynamic viscoelasticity measuring apparatus RDS-2 manufactured by Rheometric Scientific at a frequency of 1 Hz.

After a measurement sample is set in a jig of the measuring apparatus, the temperature is raised to (Tb+30)° C. to allow the sample to be attached firmly to the jig, and then the temperature is decreased from (Ta+30)° C. to (Tb−30)° C. at a rate of 0.5° C./minute, followed by leaving at rest at (Tb−30)° C. for 1 hour, and then the temperature is raised to (Tb−10)° C. at a rate of 0.5° C./minute, followed by leaving at rest at (Tb−10)° C. for 1 hour to allow crystallization to proceed sufficiently, and measurement is conducted using the resultant sample. The measurement temperature ranges from 30° C. to 200° C., and by measuring the binder melt viscoelasticity within these temperatures, curves of temperature vs. G' and temperature vs. G" can be obtained.

The crystalline resin (B) satisfying the [Condition 1] can be obtained by, for example, adjusting the ratio of the crystalline component in the (B) or by adjusting the molecular weight. For example, when the ratio of the crystalline part (b) to be described later or the ratio of the crystalline component is increased, the value of G'(Tb+20) is decreased. Examples of the crystalline component include polyols, polyisocyanates and the like having a linear structure. The value of G'(Tb+20) is also decreased by decreasing the molecular weight.

The melt initiation temperature [X] of the crystalline resin is within a temperature range of (Tb±30)° C., preferably within a temperature range of (Tb±20)° C., and more preferably within a temperature range of (Tb±15)° C.

Specifically, the [X] is preferably 30 to 100° C., and more preferably 40 to 80° C.

The melt initiation temperature [X] is a value measured as follows.

<Melt Initiation Temperature>

Using a constant-load orifice-type flow tester such as Koka flow tester {e.g., CFT-500D manufactured by SHIMADZU CORPORATION}, 1 g of a measurement sample is subjected to a load of 1.96 MPa by a plunger, while it is heated at a temperature rising rate of 6° C./minute, and extruded through a nozzle having a diameter of 1 mm and a length of 1 mm so that a graph of "an amount of the plunger descent (flow volume)" and "a temperature" is drawn. The temperature at which the piston clearly starts descending again after slight rising of the piston due to heat expansion of the sample is read from the graph, and the temperature is defined as a melt initiation temperature.

Concerning the loss modulus G" and the melt initiation temperature [X] of the crystalline resin (B), the loss modulus G"(X+20) at (X+20)° C. and the loss modulus G"(X) at X° C. need to satisfy [Condition 2], preferably satisfy [Condition 2-2], and more preferably the loss modulus G"(X+15) at (X+15)° C. and the loss modulus G" (X) at X° C. satisfy [Condition 2-3].

$$|\log G''(X+20)-\log G''(X)|>2.0 \quad [G'': \textit{loss modulus [Pa]}] \qquad \text{[Condition 2]}$$

$$|\log G''(X+20)-\log G''(X)|>2.5 \qquad \text{[Condition 2-2]}$$

$$|\log G''(X+15)-\log G''(X)|>2.5 \qquad \text{[Condition 2-3]}$$

When the melt initiation temperature [X] of the crystalline resin (B) falls within the above range, and the [Condition 2] is satisfied, the viscosity decreasing rate of the resin is high, so that it is possible to obtain equivalent image quality on both of the low temperature side and the high temperature side of the fixing temperature range. Further, the time required to reach fixable viscosity from the onset of melting is short, so that it is advantageous for obtaining excellent low-temperature fixing property. The [Condition 2] is an index of the sharp melting property of the resin, namely, how quickly and with how little heat the fixing is achieved, and it has been determined experimentally.

The crystalline resin (B) satisfying the range of the melt initiation temperature [X] and the [Condition 2] can be obtained by, for example, adjusting the ratio of the crystalline component in the constituent components of the (B). For example, as the ratio of the crystalline component is increased, the temperature difference between the [Tb] and the [X] decreases.

A resin to be used for conventional toner binders satisfies the [Condition 1], but does not satisfy the [Condition 2] in the case where the resin is a noncrystalline resin. When the resin is a crystalline resin, it satisfies the [Condition 2], but does not satisfy the [Condition 1]. Therefore, there is no toner binder that contains a resin satisfying both of the [Condition 1] and the [Condition 2]. The present invention is characterized by using a crystalline resin satisfying the [Condition 1] as a toner binder.

In the viscoelasticity characteristics of the crystalline resin (B), the ratio [G"(Tb+30)/G"(Tb+70)] of the loss modulus G" at (Tb+30)° C. to the loss modulus G" at (Tb+70)° C. is preferably 0.05 to 50, and more preferably 0.1 to 10 [Tb: the maximum peak temperature of heat of melting of (B)].

By keeping the ratio of loss moduli within the above range, more stable image quality in the fixing temperature range can be obtained.

The crystalline resin (B) satisfying the above condition of the ratio of G" can be obtained by, for example, adjusting the ratio of the crystalline component in the constituent components of the (B) or the molecular weight of the crystalline part (b) to be described later. For example, when the ratio of the crystalline part (b) or the ratio of the crystalline component is increased, the value of [G"(Tb+30)/G"(Tb+70)] is decreased. When the molecular weight of the crystalline part (b) is increased, the value of [G"(Tb+30)/G"(Tb+70)] is decreased. Examples of the crystalline component include polyols, polyisocyanates and the like having a linear structure.

The crystalline resin (B) may be composed only of the crystalline part (b), or composed of a block resin having the crystalline part (b) and a noncrystalline part (c) as far as it has crystallinity; however, from the viewpoint of fixing property (particularly, hot offset resistance), it is preferably a block resin composed of the (b) and the (c).

Also, filming onto a photoreceptor becomes less likely to occur in the case of a block resin.

In the following, a block resin composed of the crystalline part (b) and the noncrystalline part (c), which is a resin preferred as the crystalline resin (B), will be described in detail.

In the case of a block resin, the glass transition point (Tg) of the (c) is preferably 40 to 250° C., more preferably 50 to 240° C., particularly preferably 60 to 230° C., and most preferably 65 to 180° C. from the viewpoint of heat resistant storage property. The softening point [Tm] in the flow tester measurement of the (c) is preferably 100 to 300° C., more preferably 110 to 290° C., and particularly preferably 120 to 280° C.

The weight average molecular weight (hereinafter, described as Mw) in gel permeation chromatography of a tetrahydrofuran-soluble matter of the crystalline resin (B) determined by is preferably 5000 to 100000, more preferably 6000 to 90000, and particularly preferably 8000 to 80000 from the viewpoint of fixing property.

When the (B) is the block resin having the crystalline part (b) and the noncrystalline part (c), the Mw of the (b) is preferably 2000 to 80000, more preferably 4000 to 60000, and particularly preferably 7000 to 30000.

The Mw of the (c) is preferably 500 to 50000, more preferably 750 to 20000, and particularly preferably 1000 to 10000.

From the viewpoint of toner strength, the pencil hardness of the crystalline resin (B) is preferably 3B to 6H. Pencil hardness is measured by the method described below.

<Pencil Hardness>

A scratching test is carried out in accordance with JIS K5600 while applying a load of 10 g from the right above to a pencil fixed at an angle of 45 degrees, and pencil hardness at which no scratch is formed is indicated.

When the crystalline resin (B) is the block resin composed of the crystalline part (b) and the noncrystalline part (c), the ratio of the crystalline part (b) in the (B) is preferably 50% by weight or more, more preferably 60 to 96% by weight, and further preferably 65 to 90% by weight. When the ratio of the (b) is 50% by weight or more, the crystallinity of the (B) is not impaired, and low-temperature fixing property is more favorable.

When the crystalline resin (B) is the block resin composed of the crystalline part (b) and the noncrystalline part (c), it is preferably a resin in which each terminal of the linkage formed of the (b) and the (c) linearly bound in the following form is the (b), and the average value n of the number of repetition of the unit {−(c)−(b)} is 0.9 to 3.5, more preferably n=0.95 to 2.0, and particularly preferably n=1.0 to 1.5.

$$(b)\{-(c)-(b)\}_n$$

The above formula specifically means a resin in which the crystalline part (b) and the noncrystalline part (c) are bound linearly in the form of:

$$(b)[n=0],$$

$$(b)-(c)-(b)[n=1],$$

$$(b)-(c)-(b)-(c)-(b)[n=2],$$

$$(b)-(c)-(b)-(c)-(b)-(c)-(b)[n=3]$$

or the like, and a mixture thereof [excluding one composed only of units in which n=0].

When n is 3.5 or less, the crystallinity of the crystalline resin (B) is not impaired. When n is 0.9 or more, the elasticity of the (B) after melting is good, and hot offset is less likely to occur during fixing, and the fixing temperature range is further widened. Here, "n" is a calculated value determined from use amounts of raw materials [the mole ratio of (b) to (c)]. From the viewpoint of the degree of crystallinity of the crystalline resin (B), both of the terminals of the (B) are preferably the crystalline parts (b).

When both of the terminals are the noncrystalline parts (c), the degree of crystallinity decreases, and therefore it is preferable to make the ratio of the crystalline part (b) in the crystalline resin (B) be 75% by weight or more in order to impart crystallinity to the (B).

The resin to be used for the crystalline part (b) will be described.

The resin to be used for the crystalline part (b) is not particularly restricted as far as it has crystallinity. From the viewpoint of heat resistant storage property, the melting point is preferably within the range of 40 to 100° C. (more preferably within the range of 50 to 70° C.)

In the present invention, the melting point is measured by a differential scanning calorimeter {for example, DSC210 manufactured by Seiko Instruments Inc.} likewise the maximum peak temperature [Tb] of heat of melting.

The crystalline part (b) is not particularly restricted as far as it has crystallinity and it may be a composite resin. Above all, polyester resins, polyurethane resins, polyurea resins, polyamide resins, polyether resins and composite resins thereof are preferable, and linear polyester resins and composite resins containing the same are particularly preferable.

As the polyester resins used as the (b), polycondensation polyester resins synthesized from an alcohol (diol) component and an acid (dicarboxylic acid) component are preferable from the viewpoint of crystallinity. It is noted that a trifunctional or more alcohol component or a trifunctional or more acid component may be used if necessary.

Besides the polycondensation polyester resins, a lactone ring-opening polymer and a polyhydroxycarboxylic acid are also preferable as the polyester resins.

Examples of the polyurethane resins include polyurethane resins synthesized from alcohol (diol) components and isocyanate (diisocyanate) components, and the like. It is noted that a trifunctional or more alcohol component or a trifunctional or more isocyanate component may be used if necessary.

Examples of the polyamide resins include polyamide resins synthesized from amine (diamine) components and acid (dicarboxylic acid) components, and the like. It is noted that a trifunctional or more amine component or a trifunctional or more acid component may be used if necessary.

Examples of the polyurea resins include polyurea resins synthesized from amine (diamine) components and isocyanate (diisocyanate) components, and the like. It is noted that a trifunctional or more amine component or a trifunctional or more isocyanate component may be used if necessary.

In the following description, first, a diol component, a dicarboxylic acid component, a diisocyanate component, and a diamine component (each including trifunctional or more ones) to be used for such a crystalline polycondensation polyester resin, a crystalline polyurethane resin, a crystalline polyamide resin, and a crystalline polyurea resin will be described individually.

[Diol Component]

Aliphatic diols are preferable as the diol component and the number of carbon atoms thereof is preferably within the range of 2 to 36. Linear aliphatic diols are more preferable.

When the aliphatic diol is of a branched form, the crystallinity of the polyester resin is lowered to cause a descent in the melting point thereof, so that toner blocking resistance, image storage stability and low-temperature fixing property may be impaired. When the number of carbon atoms is more than 36, it may be difficult to obtain practically usable materials.

As to the diol component, the content of the linear aliphatic diol is preferably 80% by mol or more, and more preferably 90% by mol or more of the diol component to be used. When it is 80% by mol or more, the crystallinity of the polyester resin improves, and the melting point increases, so that favorable toner blocking resistance and low-temperature fixing property are realized.

Specific examples of the linear aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like. Among them, ethylene glycol, 1,3-propanediol, 1,4-butanediol, 1,6-hexanediol, 1,9-nonanediol, and 1,10-decanediol are preferable in consideration of easy availability.

Examples of other diols to be used if necessary include aliphatic diols having 2 to 36 carbon atoms other than those recited above (1,2-propylene glycol, butanediol, hexanediol, octanediol, decanediol, dodecanediol, tetradecanediol, neopentyl glycol, 2,2-diethyl-1,3-propanediol, and the like); alkylene ether glycols having 4 to 36 carbon atoms (diethylene glycol, triethylene glycol, dipropylene glycol, polyethylene glycol, polypropylene glycol, polytetramethylene ether glycol, and the like); alicyclic diols having 4 to 36 carbon atoms (1,4-cyclohexanedimethanol, hydrogenated bisphenol A, and the like); alkylene oxide (hereinafter, abbreviated as AO) [ethylene oxide (hereinafter, abbreviated as EO), propylene oxide (hereinafter, abbreviated as PO), butylene oxide (hereinafter, abbreviated as BO), and the like] adducts (the number of moles added: 1 to 30) of the above-mentioned alicyclic diols; AO (EO, PO, BO, and the like) adducts (the number of moles added: 2 to 30) of bisphenols (bisphenol A, bisphenol F, bisphenol S, and the like); polylactone diols (polyε-caprolactone diol, and the like); polybutadiene diols, and the like.

Diols having other functional groups may be used as the other diols to be used if necessary. Examples of the diols having a functional group include diols having a carboxyl group, diols having a sulfonic acid group or a sulfamic acid group, salts thereof, and the like.

Examples of the diols having a carboxyl group include dialkylolalkane acids [those having C6 to 24, for example, 2,2-dimethylol propionic acid (DMPA), 2,2-dimethylol butanoic acid, 2,2-dimethylol heptanoic acid, 2,2-dimethylol octanoic acid, and the like].

Examples of the diols having a sulfonic acid group or a sulfamic acid group include sulfamic acid diols [N,N-bis(2-hydroxyalkyl)sulfamic acids (alkyl group has Cl to 6) or AO adducts thereof (AO is EO, PO, or the like; the number of moles added AO is 1 to 6); e.g., N,N-bis(2-hydroxyethyl) sulfamic acid, a PO 2-mol adduct of N,N-bis(2-hydroxyethyl)sulfamic acid, and the like]; bis(2-hydroxyethyl)sulfonate, and the like.

Examples of a neutralization base in these diols having the neutralization base include the tertiary amines having 3 to 30 carbon atoms mentioned above (triethylamine, and the like) and/or alkali metals (sodium, and the like).

Among them, alkylene glycols having 2 to 12 carbon atoms, diols having a carboxyl group, AO adducts of bisphenols, and combination use thereof are preferable.

Examples of the tri- to octahydric or more polyols to be used if necessary include tri- to octahydric or more polyhydric aliphatic alcohols having 3 to 36 carbon atoms (alkane polyols and intramolecular or intermolecular dehydrates thereof, e.g., glycerin, trimethylolethane, trimethylolpropane, pentaerythritol, sorbitol, sorbitan, and polyglycerin; sugars and derivatives thereof, e.g., saccharose, and methylglucoside); AO adducts (the number of moles added: 2 to 30) of trisphenols (trisphenol PA, and the like); AO adducts (the number of moles added: 2 to 30) of novolac resins (phenol novolac, cresol novolac, and the like); acrylic polyols [copolymers of hydroxyethyl (meth)acrylate and other vinyl-based monomers]; and the like.

Among them, tri- to octahydric or more polyhydric aliphatic alcohols and AO adducts of novolac resins are preferable, and AO adducts of novolac resins are more preferable.

[Dicarboxylic Acid Component]

Examples of the dicarboxylic acid component include various dicarboxylic acids; however, aliphatic dicarboxylic acids and aromatic dicarboxylic acids are preferable, and the aliphatic dicarboxylic acids are preferably linear carboxylic acids.

Examples of the dicarboxylic acids include alkane dicarboxylic acids having 4 to 36 carbon atoms (succinic acid, adipic acid, sebacic acid, azelaic acid, dodecane dicarboxylic acid, octadecane dicarboxylic acid, decyl succinic acid, and the like); alicyclic dicarboxylic acids having 6 to 40 carbon atoms [dimer acids (dimerized linoleic acid), and the like], alkene dicarboxylic acids having 4 to 36 carbon atoms (alkenyl succinic acids such as dodecenyl succinic acid, pentadecenyl succinic acid and octadecenyl succinic acid, maleic acid, fumaric acid, citraconic acid, and the like); aromatic dicarboxylic acids having 8 to 36 carbon atoms (phthalic acid, isophthalic acid, terephthalic acid, tert-butylisophthalic acid, 2,6-naphthalene dicarboxylic acid, 4,4'-biphenyl dicarboxylic acid, and the like), and the like.

Acid anhydrides or lower alkyl esters having 1 to 4 carbon atoms of those described above (methyl esters, ethyl esters, and isopropyl esters, and the like) may also be used as the dicarboxylic acids or tri- to hexavalent or more polycarboxylic acids.

It is particularly preferable to use an aliphatic dicarboxylic acid (a linear carboxylic acid, in particular) singly among these dicarboxylic acids; however, copolymers of aromatic dicarboxylic acids (terephthalic acid, isophthalic acid, tert-butylisophthalic acid, and lower alkyl esters thereof are preferable) with aliphatic dicarboxylic acids are preferable as well. The amount of the aromatic dicarboxylic acid used for copolymerization is preferably 20% by mol or less.

Examples of the dicarboxylic acid component principally include, but are not limited to, the carboxylic acids provided above. Among them, adipic acid, sebacic acid, dodecane dicarboxylic acid, terephthalic acid, and isophthalic acid are preferable in consideration of crystallinity and easy availability.

[Diisocyanate Component]

Examples of the diisocyanate include aromatic diisocyanates having 6 to 20 carbon atoms (excluding carbon atoms in NCO group, the same is true for the following description), aliphatic diisocyanates having 2 to 18 carbon atoms, alicyclic diisocyanates having 4 to 15 carbon atoms, aromatic aliphatic diisocyanates having 8 to 15 carbon atoms, and modified products of the aromatic aliphatic diisocyanates (modified products containing a urethane group, a carbodiimide group, an allophanate group, a urea group, a biuret group, a urethodione group, a urethoimine group, an isocyanurate group, an oxazolidone group, and the like), and mixtures of two or more of these. Further, trivalent or more polyisocyanates may be used together if necessary.

Specific examples of the aromatic diisocyanates (including trivalent or more polyisocyanates) include 1,3- and/or 1,4-phenylene diisocyanate, 2,4- and/or 2,6-tolylene diisocyanate (TDI), crude TDI, 2,4'- and/or 4,4'-diphenylmethane diisocyanate (MDI), crude MDI [phosgenated crude diaminophenylmethane [a condensation product of formaldehyde with an aromatic amine (aniline) or a mixture thereof; a mixture of diaminodiphenylmethane and a small amount (for example, 5 to 20% by weight) of a trifunctional or more polyamine]: polyallylpolyisocyanate (PAPI)], 1,5-naphthylene diisocyanate, 4,4',4"-triphenylmethane triisocyanate, m- and p-isocyanato phenylsulfonyl isocyanate, and the like.

Specific examples of the aliphatic diisocyanates (including trivalent or more polyisocyanates) include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl-2,6-diisocyanato hexanoate, and the like.

Specific examples of the alicyclic diisocyanates include isophorone diisocyanate (IPDI), dicyclohexymethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate, and the like.

Specific examples of the aromatic aliphatic diisocyanates include m- and/or p-xylylene diisocyanate (XDI), α,α,α',α'-tetramethylxylylene diisocyanate (TMXDI), and the like.

Examples of the modified products of the diisocyanates include modified products containing a urethane group, a carbodiimide group, an allophanate group, a urea group, a biuret group, a urethodione group, a urethoimine group, an isocyanurate group, an oxazolidone group, and the like.

Specific examples thereof include modified products of diisocyanates such as modified MDI (urethane-modified MDI, carbodiimide-modified MDI, trihydrocarbyl phosphate-modified MDI, and the like) and urethane-modified TDI, and mixtures of two or more thereof [e.g., combinational use of modified MDI and urethane-modified TDI (isocyanate-containing prepolymers)].

Among them, aromatic diisocyanates having 6 to 15 carbon atoms, aliphatic diisocyanates having 4 to 12 carbon atoms, and alicyclic diisocyanates having 4 to 15 carbon atoms are preferable, and TDI, MDI, HDI, hydrogenated MDI, and IPDI are particularly preferable.

[Diamine Component]

As examples of the diamine (including trivalent or more polyamines to be used if necessary), examples of aliphatic diamines (C2 to C18) include [1] aliphatic diamines {C2 to C6 alkylene diamines (ethylenediamine, propylenediamine, trimethylenediamine, tetramethylenediamine, hexamethylenediamine, and the like), polyalkylene (C2 to C6) diamines [diethylenetriamine, iminobispropylamine, bis(hexamethylene)triamine, triethylenetetramine, tetraethylenepentamine, pentaethylenehexamine, and the like]}; [2] alkyl (C1 to C4) or hydroxyalkyl (C2 to C4) substituted compounds thereof [dialkyl (C1 to C3) aminopropylamine, trimethylhexamethylenediamine, aminoethylethanolamine, 2,5-dimethyl-2,5-hexamethylenediamine, methyliminobispropylamine, and the like]; [3] alicyclic- or heterocyclic-ring containing aliphatic diamines {alicyclic diamines (C4 to C15) [1,3-d]aminocyclohexane, isophoronediamine, menthenediamine, 4,4'-methylenedicyclohexanediamine (hydrogenated methylene dianiline), and the like], heterocyclic diamines (C4 to C15) [piperazine, N-aminoethylpiperazine, 1,4-diaminoethylpiperazine, 1,4-bis(2-amino-2-methylpropyl)piperazine, 3,9-bis(3-aminopropyl)-2,4,8,10-tetraoxaspiro[5,5]undecane, and the like]; [4] aromatic ring-containing aliphatic amines (C8 to C15) (xylylenediamine, tetrachloro-p-xylylenediamine, and the like), and the like.

Examples of the aromatic diamines (C6 to C20) include: [1] unsubstituted aromatic diamines [1,2-, 1,3- and 1,4-phenylenediamine, 2,4'- and 4,4'-diphenylmethanediamine, crude diphenylmethanediamine (polyphenyl polymethylene polyamine), diaminodiphenylsulfone, benzidine, thiodianiline, bis(3,4-diaminophenyl)sulfone, 2,6-diaminopyridine, m-aminobenzylamine, triphenylmethane-4,4',4"-triamine, naphthylene diamine, and the like; [2] aromatic diamines having a nuclear substitutive alkyl group [C1 to C4 alkyl groups such as a methyl group, an ethyl group, a n-propyl and an i-propyl groups, and a butyl group], for example, 2,4- and 2,6-tolylenediamines, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenylether, 3,3',5,5'-tetraisopropyl-4,4'-diaminodiphenylsulfone, and the like], and mixtures of these isomers at various ratios; [3] aromatic diamines having a nuclear substitutive electron attractive group (halogen groups such as Cl, Br, I, and F groups; alkoxy groups such as methoxy and ethoxy groups; a nitro group, and the like) [methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'- methylenebis(2-fluoroaniline), 4-aminophenyl-2-chloroaniline, and the like]; and [4] aromatic diamines having a secondary amino group [those in which a part of or all of —$NH_2$— of the above-mentioned aromatic diamines [1] to [3] is substituted with —NH—R' (R' is an alkyl group, e.g., a lower alkyl group such as a methyl or ethyl group)][4,4'-di(methylamino)diphenylmethane, 1-methyl-2-methylamino-4-aminobenzene, and the like].

Besides these, examples of the diamine component include polyamide polyamines [low molecular-weight polyamide polyamines obtained by condensation of dicarboxylic acids (dimer acid, and the like) and excess (2 mol or more per 1 mol of an acid) polyamines (the above-mentioned alkylene diamine, polyalkylene polyamine, and the like), and the like], polyether polyamines [hydrides of cyanoethylated polyether polyols (polyalkyleneglycol, and the like), and the like], and the like.

Among the crystalline polyester resins, a lactone ring-opening polymer can be obtained by, for example, ring-opening polymerization of lactones such as monolactones having 3 to 12 carbon atoms, e.g., β-propiolactone, γ-butyrolactone, δ-valerolactone, ϵ-caprolactone, and the like (the number of ester groups in the ring is one) using a catalyst such as a metal oxide or an organometal compound. Among them, from the viewpoint of crystallinity, a preferable lactone is ϵ-caprolactone.

When a glycol is used as an initiator, a lactone ring-opening polymer having a hydroxyl group at its terminal is obtained. For example, it can be obtained by reacting the above-mentioned lactones with the aforementioned diol component such as ethylene glycol or diethylene glycol in the presence of a catalyst. Organic tin compounds, organic titanium compounds, organic halogenated tin compounds, and the like are common as the catalyst, and it is possible to obtain a lactone ring-opening polymer by adding the catalyst in a range of about 0.1 to 5000 ppm and performing polymerization at 100 to 230° C. preferably under an inert atmosphere. The lactone ring-opening polymer may be one having been modified at its terminal so as to become, for example, a carboxyl group. The lactone ring-opening polymer is a thermoplastic aliphatic polyester resin having high crystallinity. The lactone ring-opening polymer may be a commercially available product, and examples thereof include HIP, H4, H5, and H7 (each being highly crystalline polycaprolactone having a melting point of about 60° C. and a Tg of about −60° C.) of PLACCEL series produced by Daicel Corporation, and the like.

Among the crystalline polyester resins, a polyhydroxycarboxylic acid can be obtained by direct dehydration condensation of a hydroxycarboxylic acid such as glycolic acid or lactic acid (L isomer, D isomer, or racemic mixture); however, it is preferable, from the viewpoint of adjustment of the molecular weight, to perform ring-opening polymerization of a cyclic ester having 4 to 12 carbon atoms (the number of ester groups in the ring is 2 to 3) corresponding to a dehydration condensate between two molecules or three molecules of a hydroxycarboxylic acid such as glycolide or lactide (L isomer, D isomer, or racemic mixture) by using a catalyst such as a metal oxide or an organometal compound. Among them, from the viewpoint of crystallinity, preferable cyclic esters are L-lactide and D-lactide.

When a glycol is used as an initiator, a polyhydroxycarboxylic acid backbone having a hydroxyl group at its terminal is obtained. It can be obtained by, for example, reacting the above-mentioned cyclic ester with the aforementioned diol component such as ethylene glycol or diethylene glycol in the presence of a catalyst. Organic tin compounds, organic titanium compounds, organic halogenated tin compounds, and the like are common as the catalyst, and it is possible to obtain a polyhydroxycarboxylic acid by adding the catalyst in a range of about 0.1 to 5000 ppm and performing polymerization at 100 to 230° C. preferably under an inert atmosphere. The polyhydroxycarboxylic acid may be one having been modified at its terminal so as to become, for example, a carboxyl group.

Examples of the polyether resin include crystalline polyoxyalkylene polyol, and the like.

A method for producing the crystalline polyoxyalkylene polyol is not particularly limited, and any conventionally known method may be used.

For example, there are known a method for ring-opening polymerization of a chiral AO with a catalyst usually used in the polymerization of AO (described in, e.g., Journal of the American Chemical Society, 1956, Vol. 78, No. 18, p. 4787-4792), and a method for ring-opening polymerization of an inexpensive racemic AO by using a complex having a sterically bulky and special chemical structure as a catalyst.

As the methods using a special complex, there are known a method using a compound prepared by bringing a lanthanoid complex and organic aluminum into contact with each other as a catalyst (described in, e.g., JP-A-H11-12353), a method of reacting bimetal voxo alkoxide with a hydroxyl compound beforehand (described in, e.g., JP-A-2001-521957), and the like.

Further, a method using a salen complex as a catalyst (described in, e.g., Journal of the American Chemical Society, 2005, Vol. 127, No. 33, p. 11566-11567) is known as a method for obtaining a polyoxyalkylene polyol having very high isotacticity.

For example, when a chiral AO is used and a glycol or water is used as an initiator at the time of ring-opening polymerization thereof, a polyoxyalkylene glycol having a hydroxyl group at its terminal and having an isotacticity of 50% or more is obtained. The polyoxyalkylene glycol having an isotacticity of 50% or more may be one having been modified at its terminal so as to become, for example, a carboxyl group. The polyoxyalkylene glycol is usually crystalline if the isotacticity is 50% or more.

Examples of the above-mentioned glycol include the aforementioned diol component and the like, and examples of the carboxylic acid to be used for carboxy modification include the aforementioned dicarboxylic acid component and the like.

Examples of the AO to be used for producing the crystalline polyoxyalkylene polyol include those having 3 to 9 carbon atoms and examples thereof include the following compounds.

AOs having 3 carbon atoms [PO, 1-chlorooxetane, 2 chlorooxetane, 1,2-dichlorooxetane, epichlorohydrin, epibromohydrin]; AOs having 4 carbon atoms [1,2-BO, methyl glycidyl ether]; AOs having 5 carbon atoms [1,2-pentylene oxide, 2,3-pentylene oxide, 3-methyl-1,2-butylene oxide]; AOs having 6 carbon atoms [cyclohexene oxide, 1,2-hexylene oxide, 3-methyl-1,2-pentylene oxide, 2,3-hexylene oxide, 4-methyl-2,3-pentylene oxide, allyl glycidyl ether]; AOs having 7 carbon atoms [1,2-heptylene oxide]; AOs having 8 carbon atoms [styrene oxide]; AOs having 9 carbon atoms [phenyl glycidyl ether], and the like.

Among these AOs, PO, 1,2-BO, styrene oxide, and cyclohexene oxide are preferable. PO, 1,2-BO, and cyclohexene oxide are more preferable. From the viewpoint of polymerization rate, PO is most preferable.

One of these AOs may be used alone or two or more thereof may be used in combination.

The isotacticity of the crystalline polyoxyalkylene polyol is preferably 70% or more, more preferably 80% or more, further preferably 90% or more, and most preferably 95% or more from the viewpoint of high sharp melting property and blocking resistance of a crystalline polyether resin to be obtained.

The isotacticity can be calculated by the method described in Macromolecules, Vol. 35, No. 6, pp. 2389-2392 (2002) and is determined in the following manner.

About 30 mg of a measurement sample is weighed in a sample tube for $^{13}$C-NMR having a diameter of 5 mm, and is dissolved by the addition of about 0.5 mL of a deuterated solvent, thereby preparing a sample for analysis. Here, the deuterated solvent is deuterated chloroform, deuterated toluene, deuterated dimethyl sulfoxide, deuterated dimethyl formamide, or the like, and a solvent capable of dissolving the sample is appropriately selected.

Signals originated from three kinds of methine groups in $^{13}$C-NMR are respectively observed at near 75.1 ppm for a syndiotactic signal (S), near 75.3 ppm for a heterotactic signal (H), and near 75.5 ppm for isotactic signal (I). The isotacticity is calculated by the following calculation formula (a):

$$\text{Isotacticity}(\%)=[I/(I+S+H)]\times 100 \quad (a)$$

wherein, I is an integral of an isotactic signal; S is an integral of a syndiotactic signal; and H is an integral of a heterotactic signal.

When the crystalline resin (B) is the block resin having the crystalline part (b) and the noncrystalline part (c), examples of the resin to be used for the formation of the noncrystalline part (c) include, but are not limited to, a polyester resin, a polyurethane resin, a polyurea resin, a polyamide resin, a polyether resin, a vinyl resin (polystyrene, styrene-acrylic polymers, and the like), a polyepoxy resin, and the like.

However, since the resin to be used for the formation of the crystalline part (b) is preferably a polyester resin, a polyurethane resin, a polyurea resin, a polyamide resin, or a polyether resin, the resin to be used for the formation of the noncrystalline part (c) is also preferably a polyester resin, a polyurethane resin, a polyurea resin, a polyamide resin, a polyether resin, or a composite resin thereof in consideration of the fact that they are compatible with each other at the time of heating. A polyurethane resin and a polyester resin are more preferable.

These noncrystalline resins may have compositions similar to those of the crystalline part (b), and specific examples of the monomer to be used include the aforementioned diol component, the aforementioned dicarboxylic acid component, the aforementioned diisocyanate component, the aforementioned diamine component, and the aforementioned AO; and any combination is applicable as far as a noncrystalline resin is formed.

[Method for Producing Block Polymer]

As to a block polymer composed of a crystalline part (b) and a noncrystalline part (c), whether a binding agent is used or not is selected in consideration of reactivity of each terminal functional group, and when a binding agent is used, the type of the binding agent suited for the terminal functional group is selected, and the (b) and the (c) can be bound to give a block polymer.

When a binding agent is not used, reaction between a terminal functional group of a resin to form the (b) and a terminal functional group of a resin to form the (c) is allowed to proceed under heating and reduced pressure if necessary. In particular, in the case of reaction between an acid and an alcohol or reaction between an acid and an amine, the reaction proceeds smoothly when one of the resins has a high acid value and the other resin has a high hydroxyl value or a high amine value. The reaction temperature is preferably 180° C. to 230° C.

When a binding agent is used, a variety of binding agents may be used. It can be obtained by a dehydration reaction or an addition reaction by using a polyvalent carboxylic acid, a polyhydric alcohol, a polyvalent isocyanate, a polyfunctional epoxy, an acid anhydride, or the like.

Examples of the polyvalent carboxylic acid and the acid anhydride include those similar to those recited for the aforementioned dicarboxylic acid component. Examples of the polyhydric alcohol include those similar to those recited for the aforementioned diol component. Examples of the polyvalent isocyanate include those similar to those recited for the aforementioned diisocyanate component. Examples of the polyfunctional epoxy include bisphenol A type and bisphenol F type epoxy compounds, phenol novolac-type epoxy compounds, cresol novolac-type epoxy compounds, hydrogenated bisphenol A-type epoxy compounds, diglycidyl ethers of AO adduct of bisphenol A or bisphenol F, diglycidyl ethers of AO adduct of hydrogenated bisphenol A, respective diglycidyl ethers of diols (ethylene glycol, propylene glycol, neopentyl glycol, butanediol, hexanediol, cyclohexanedimethanol, polyethylene glycol, polypropylene glycol, and the like), trimethylolpropane di- and/or triglycidyl ether, pentaerythritol tri- and/or tetraglycidyl ether, sorbitol hepta- and/or hexaglycidyl ether, resorcin diglycidyl ether, dicyclopentadiene-phenol addition type glycidyl ether, methylenebis(2,7-dihydroxynaphthalene)tetraglycidyl ether, 1,6-dihydroxynaphthalenediglycidyl ether, polybutadiene diglycidyl ether, and the like.

Among the methods of binding the (b) and the (C), an example of the dehydration reaction is reaction in which both of the crystalline part (b) and the noncrystalline part (c) are resins having alcohols on both terminals and these are bound with a binding agent (for example, a polyvalent carboxylic acid). In this case, the reaction occurs, for example, in the absence of a solvent at a reaction temperature of 180° C. to 230° C., so that a block polymer is obtained.

Examples of the addition reaction include reaction in which both of the crystalline part (b) and the noncrystalline part (c) are resins having a hydroxyl group at their terminals and these are bound by a binding agent (for example, a polyvalent isocyanate), and reaction in which one of the crystalline part (b) and the noncrystalline part (c) is a resin having a hydroxyl group at its terminal and the other is a resin having an isocyanate group at its terminal and these are bound without using a binding agent. In this case, for example, a block polymer is obtained by, for example, dissolving both of the crystalline part (b) and the noncrystalline part (c) in a solvent capable of dissolving both of them, adding a binding agent if necessary thereto, and performing the reaction at a reaction temperature of 80° C. to 150° C.

The block polymer described above is preferable as the crystalline resin (B); however, a resin composed only of the crystalline part (b) and not having the noncrystalline part (c) may also be used.

Examples of the composition of the (B) composed only of the crystalline part include those similar to those recited for the crystalline part (b) described above and a crystalline vinyl resin.

As the crystalline vinyl resin, those including a vinyl monomer (m) having a crystalline group and, if necessary, a vinyl monomer (n) not having a crystalline group as constituent units are preferable.

Examples of the vinyl monomer (m) include a linear alkyl (meth)acrylate (m1) having an alkyl group with 12 to 50 carbon atoms (the linear alkyl group having 12 to 50 carbon atoms is a crystalline group), a vinyl monomer (m2) having a unit of the crystalline part (b), and the like.

As the crystalline vinyl resin, those having the linear alkyl (meth)acrylate (m1) having an alkyl group with 12 to 50 (preferably 16 to 30) carbon atoms as the vinyl monomer (m) are further preferable.

Examples of the (m1) include lauryl (meth)acrylate, tetradecyl (meth)acrylate, stearyl (meth)acrylate, eicosyl (meth) acrylate, behenyl (meth)acrylate, and the like, in each of which the alkyl group is linear.

In the present invention, the alkyl (meth)acrylate means an alkyl acrylate and/or an alkyl methacrylate, and the same description will be employed hereinafter.

In the vinyl monomer (m2) having a unit of the crystalline part (b), for introducing the unit of the crystalline part (b) into the vinyl monomer, whether a binding agent (coupling agent) is used or not is selected in consideration of the reactivity of each terminal functional group, and when a binding agent is used, a binding agent suited for the terminal functional group is selected, and the crystalline part (b) and the vinyl monomer can be bound together to give the vinyl monomer (m2) having a unit of the crystalline part (b).

When a binding agent is not used at the time of preparing the vinyl monomer (m2) having a unit of the crystalline part (b), reaction between a terminal functional group of the crystalline part (b) and a terminal functional group of the vinyl monomer is allowed to proceed under heating and reduced pressure if necessary. Particularly in the case of reaction between a carboxyl group and a hydroxyl group or reaction between a carboxyl group and an amino group as the terminal functional groups, the reaction proceeds smoothly when one of the resins has a high acid value and the other resin has a high hydroxyl value or a high amine value. The reaction temperature is preferably 180° C. to 230° C.

When a binding agent is used, various binding agents may be used in accordance with the kind of the terminal functional group.

Specific examples of the binding agent and a method for producing the vinyl monomer (m2) using the binding agent include a method similar to the above-described method for producing a block polymer.

Examples of the vinyl monomer (n) not having a crystalline group include, but are not particularly limited to, a vinyl monomer (n1) having a molecular weight of 1000 or less that is usually used in the production of a vinyl resin other than the vinyl monomer (m) having a crystalline group, a vinyl monomer (n2) having a unit of the above-described noncrystalline part (c), and the like.

Examples of the vinyl monomer (n1) include styrenes, (meth)acrylic monomers, carboxyl group-containing vinyl monomers, other vinyl ester monomers, aliphatic hydrocarbon-based vinyl monomers, and the like, and two or more thereof may be used in combination.

Examples of the styrenes include styrene, alkylstyrenes having an alkyl group with 1 to 3 carbon atoms [e.g., α-methylstyrene and p-methylstyrene], and the like, and styrene is preferable.

Examples of the (meth)acrylic monomers include alkyl (meth)acrylates having an alkyl group with 1 to 11 carbon atoms, branched alkyl (meth)acrylates having an alkyl group with 12 to 18 carbon atoms [e.g., methyl (meth)acrylate, ethyl (meth)acrylate, butyl (meth)acrylate, and 2-ethylhexyl (meth)acrylate], hydroxylalkyl (meth)acrylates having an alkyl group with 1 to 11 carbon atoms [e.g., hydroxylethyl (meth)acrylate], alkylamino group-containing (meth)acrylates having an alkyl group with 1 to 11 carbon atoms [e.g., dimethylaminoethyl (meth)acrylate and diethylaminoethyl (meth)acrylate], nitrile group-containing vinyl monomers [e.g., acrylonitrile and methacrylonitrile], and the like.

Examples of the carboxyl group-containing vinyl monomers include monocarboxylic acids [having 3 to 15 carbon atoms, e.g., (meth)acrylic acid, crotonic acid, and cinnamic acid], dicarboxylic acids [having 4 to 15 carbon atoms, e.g., maleic acid (maleic anhydride), fumaric acid, itaconic acid, and citraconic acid], dicarboxylic acid monoesters [monoalkyl (having 1 to 18 carbon atoms) esters of the dicarboxylic acids mentioned above, e.g., maleic acid monoalkyl ester, fumaric acid monoalkyl ester, itaconic acid monoalkyl ester, and citraconic acid monoalkyl ester], and the like.

Examples of the other vinyl ester monomers include aliphatic vinyl esters [having 4 to 15 carbon atoms, e.g., vinyl acetate, vinyl propionate, and isopropenyl acetate], unsaturated carboxylic acid polyhydric (di- to trihydric or more) alcohol esters [having 8 to 50 carbon atoms, e.g., ethylene glycol di(meth)acrylate, propylene glycol di(meth)acrylate, neopentyl glycol di(meth)acrylate, trimethylol propane tri (meth)acrylate, 1,6-hexanediol diacrylate, and polyethylene glycol di(meth)acrylate], aromatic vinyl esters [having 9 to 15 carbon atoms, e.g., methyl 4-vinyl benzoate], and the like.

Examples of the aliphatic hydrocarbon-based vinyl monomers include olefins [having 2 to 10 carbon atoms, e.g., ethylene, propylene, butene, and octene], dienes [having 4 to 10 carbon atoms, e.g., butadiene, isoprene, and 1,6-hexadiene], and the like.

Among these (b1), the (meth)acryl monomers and the carboxyl group-containing vinyl monomers are preferable.

In the vinyl monomer (n2) having a unit of the noncrystalline part (c), an example of a method for introducing the unit of the noncrystalline part (c) into the vinyl monomer include a method similar to the above-described method for introducing the unit of the crystalline part (b) into the vinyl monomer in the vinyl monomer (m2) having the unit of the crystalline part (b).

The content of the constituent unit of the vinyl monomer (m) having a crystalline group in the crystalline vinyl resin is preferably 30% by weight or more, more preferably 35 to 95% by weight, and particularly preferably 40 to 90% by weight. When it is within this range, the crystallinity of the vinyl resin is not impaired and good heat resistant storage stability is achieved. The content of the linear alkyl (meth) acrylate (m1) having an alkyl group with 12 to 50 carbon atoms in the (m) is preferably 30 to 100% by weight, and more preferably 40 to 80% by weight.

By polymerizing these vinyl monomers through a known method, a crystalline vinyl resin is obtained.

The composition of the crystalline resin (B) is preferably a urethane- or urea-modified polyester resin (including a composite resin with a polyurethane resin and/or a polyurea resin), and a vinyl resin containing a linear alkyl group having 12 to 50 carbon atoms, because a hot offset resistance improving effect is exhibited greatly when used together with the polyester resin (A).

The SP value [solubility parameter: $(cal/cm^3)^{1/2}$] of the crystalline resin (B) is preferably 9.0 to 12.5, more preferably 9.1 to 12.0, particularly preferably 9.2 to 11.5, and most preferably 9.3 to 11.0.

When the SP value is within the range provided above, good durability is achieved in the case of being used together with the polyester resin (A). When the SP value is 12.5 or less, good anti-blocking property is achieved.

The SP value in the present invention is calculated by the method proposed by Fedors et al. and described in the following document.

"POLYMER ENGINEERING AND SCIENCE, FEBRUARY, 1974, Vol. 14, No. 2, ROBERT F. FEDORS. (pp. 147-154)"

The toner binder of the present invention comprises a noncrystalline linear polyester resin (C) if necessary in addition to the polyester resin (A) and the crystalline resin (B). Inclusion of the (C) is preferable because it widens the fixing temperature range.

The noncrystalline linear polyester resin (C) is obtained by polycondensation of a carboxylic acid component (x) with a polyol component (y) and is a resin different from the polyester resin (A). The carboxylic acid component (x) of the (C) is preferably composed of a polycarboxylic acid and, if necessary, a monocarboxylic acid, and more preferably is composed of a monocarboxylic acid and a polycarboxylic acid.

Examples of the monocarboxylic acid include those similar to those recited for the monocarboxylic acid (x3) in the carboxylic acid component (x) of the above-described polyester resin (A).

Among the monocarboxylic acids, aromatic monocarboxylic acids having 7 to 36 carbon atoms are preferable; benzoic acid, methylbenzoic acid, and p-tert-butylbenzoic acid are more preferable; and benzoic acid is particularly preferable.

In the noncrystalline linear polyester resin (C), the monocarboxylic acid is used preferably in an amount (calculated value) corresponding to an amount such that 5 to 85 mol %, more preferably 8 to 80 mol %, and particularly preferably 10 to 76 mol % of terminal hydroxyl groups out of the terminal hydroxyl groups of the (C) are esterified with the monocarboxylic acid from the viewpoint of storage stability and productivity.

From the viewpoint of storage stability, the amount of the monocarboxylic acid in the constituent units of the (C) is preferably 30 mol % or less, more preferably 1 to 25 mol %, and particularly preferably 2 to 21 mol % based on the whole carboxylic acid component (x).

Examples of the polycarboxylic acid include dicarboxylic acids and/or trivalent or more polycarboxylic acids.

Examples of the dicarboxylic acids include the aforementioned alkane dicarboxylic acids having 4 to 36 carbon atoms [in the carboxylic acid component (x) of the polyester resin (A)], the aforementioned alicyclic dicarboxylic acids having 6 to 40 carbon atoms, the aforementioned alkene dicarboxylic acids having 4 to 36 carbon atoms, aromatic dicarboxylic acids having 8 to 36 carbon atoms (phthalic, isophthalic, terephthalic and naphthalene dicarboxylic acid, and the like), ester-forming derivatives thereof, and the like; and two or more thereof may be used in combination.

Among them, alkene dicarboxylic acids having 4 to 20 carbon atoms, aromatic dicarboxylic acids having 8 to 20 carbon atoms, and ester-forming derivatives thereof are preferable, and terephthalic acid, isophthalic acid, and/or lower alkyl (alkyl group has 1 to 4 carbon atoms) esters thereof are more preferable.

Examples of the trivalent or more polycarboxylic acid include those similar to those recited for the trivalent or more polycarboxylic acid (x2) in the carboxylic acid component (x) of the above-described polyester resin (A).

Among the trivalent or more polycarboxylic acids, trimellitic acid, pyromellitic aid, and ester-forming derivatives thereof are preferable.

The content of terephthalic acid, isophthalic acid, and/or lower alkyl (alkyl group has 1 to 4 carbon atoms) esters thereof in the polycarboxylic acid of the noncrystalline linear polyester resin (C) is preferably 85 to 100 mol %, and more preferably 90 to 100 mol % from the viewpoint of storage stability.

The mole ratio of terephthalic acid and/or the lower alkyl ester thereof to isophthalic acid and/or the lower alkyl ester thereof is preferably 20:80 to 100:0, and more preferably 25:75 to 80:20 from the viewpoint of mechanical strength of the resin.

The content of the aromatic carboxylic acid in the carboxylic acid component (x) of the (C) is preferably 80 to 100 mol %, and more preferably 85 to 100 mol % from the viewpoint of storage stability and fixing property.

Examples of the polyol component (y) of the noncrystalline linear polyester resin (C) include those similar to those recited for the polyol component (y) of the above-described polyester resin (A), and aliphatic diols (yc1) having 2 to 4 carbon atoms; diols (yc2) having an SP value of 11.5 to 16.0 $(cal/cm^3)^{1/2}$, and trihydric or more polyols are preferable.

Examples of the aliphatic diols (yc1) having 2 to 4 carbon atoms include ethylene glycol, 1,2-propylene glycol, 1,3-propylene glycol, 1,4-butanediol, and the like; and two or more thereof may be used in combination.

Among them, ethylene glycol is preferable.

Examples of the diols (yc2) having an SP value of 11.5 to 16.0 include neopentyl glycol, 2,3-dimethylbutane-1.4-diol, cyclohexane dimethanol, and polyoxyalkylene ethers of bisphenol A (oxyalkylene group has 2 and/or 3 carbon atoms, the number of AO units: 2 to 30), polyoxyalkylene ethers of bisphenol F (oxyalkylene group has 2 and/or 3 carbon atoms, the number of AO units: 2 to 30), the polyoxyalkylene ethers of bisphenol S (oxyalkylene group has 2 and/or 3 carbon atoms, the number of AO units: 2 to 30), hydrogenated bisphenol A, and the like; and two or more thereof may be used in combination.

Among them, neopentyl glycol and polyoxyalkylene ethers of bisphenol A are preferable.

Examples of the trihydric or more polyols include those similar to those recited for the trihydric or more polyols in the polyol component (y) of the above-mentioned polyester resin (A), and preferable examples thereof are also similar.

The content of the aliphatic diol (yc1) having 2 to 4 carbon atoms in the polyol component (y) of the noncrystalline linear polyester resin (C) [the polyol component in this section means a polyol component to be a constituent unit of a linear polyester resin (A) excluding those to be excluded to the outside of the system during a polycondensation reaction] is preferably 50 to 95 mol %, and more preferably 60 to 93 mol % from the viewpoint of fixing property.

The content of the diol (yc2) having an SP value of 11.5 to 16.0 in the polyol component (y) is preferably 5 to 50 mol %, and more preferably 7 to 40 mol % from the viewpoint of storage stability.

The content of the total of the trihydric or more polyols and the trivalent or more polycarboxylic acids in the total of the carboxylic acid component (x) and the polyol component (y) of the (C) is preferably 0.1 to 15 mol %, and more preferably 0.2 to 12 mol %. When it is 0.1 mol % or more, the storage stability of a toner becomes good, whereas when it is 15 mol % or less, the electrostatic characteristic of a toner becomes good.

A method for producing the linear polyester resin (C) by polycondensing the carboxylic acid component (x) composed of a polycarboxylic acid and, if necessary, a monocarboxylic acid and the polyol component (y) is not particularly limited, and for example, the (x) and the (y) may be subjected to polycondensation at once; however, it may be performed that at least part of the polycarboxylic acid and the (y) are subjected to polycondensation beforehand in such an equivalent ratio that the hydroxyl groups of the (y) become excessive, then the hydroxyl groups of the resulting polycondensate (CO) are reacted with the carboxyl groups of the monocarboxylic acid, followed by additional polycondensation. It may be performed that if necessary, after the polycondensation of the (CO) with the monocarboxylic acid (x1), a trivalent or more polycarboxylic acid is loaded and allowed to react substantially as monofunctional or bifunctional, and then polycondensation is further performed under such conditions that the remaining functional groups are left unreacted.

The reaction content ratio of the polyol component (y) to the polycarboxylic acid component (x) is preferably set to 2/1 to 1/2, more preferably 1.5/1 to 1/1.3, and particularly preferably 1.3/1 to 1/1.2, expressed by an equivalent ratio [OH]/[COOH] of a hydroxyl group to a carboxylic group.

The SP value of the noncrystalline linear polyester resin (C) is preferably 11.5 to 13.0, and more preferably 11.6 to 12.8.

When the SP value is 11.5 or more, the fixing property (on a higher temperature side) becomes favorable, whereas when it is 13.0 or less, the anti-blocking property is improved.

The acid value of the noncrystalline linear polyester resin (C) is preferably 0 to 60, more preferably 1 to 55, and particularly preferably 2 to 50. If the acid value is 60 or less, the electrostatic characteristic achieved when used in toner is not lowered.

The hydroxyl value of the (C) is preferably 0 to 125, and more preferably 1 to 100. When the hydroxyl value is 125 or less, the hot offset resistance and the storage stability achieved when used in toner become good.

The Mp in gel permeation chromatography of a tetrahydrofuran-soluble matter of the noncrystalline linear polyester resin (C) is preferably 1000 to 10000, more preferably 2000 to 9500, and particularly preferably 2500 to 9000. When the Mp is 2000 or more, resin strength required for fixing is obtained, whereas when it is 12000 or less, the low-temperature fixing property achieved when used in toner is good.

The softening point [Tm] of the noncrystalline linear polyester resin (C) is preferably 70 to 120° C., more preferably 75 to 110° C., and particularly preferably 80 to 105° C. Within this range, the balance between the hot offset resistance and the low-temperature fixing property becomes good.

From the viewpoint of storage stability, the glass transition temperature [Tg] of the noncrystalline linear polyester resin (C) to be used for the present invention is preferably 45° C. or higher. When it is 75° C. or lower, the low-temperature fixing property achieved when used in toner is good.

The content of a THF-insoluble matter in the noncrystalline linear polyester resin (C) is preferably 5% or less from the viewpoint of low-temperature fixing property achieved when used in toner. It is more preferably 4% or less, and particularly preferably 3% or less.

The content of the THF-insoluble matter in the present invention is determined by the following method.

THF (50 ml) is added to a sample (0.5 g), and the mixture is allowed to reflux with stirring for 3 hours. The mixture is allowed to cool, then the insoluble matter is filtered with a glass filter, and the resin matter remaining on the glass filter is dried under reduced pressure at 80° C. for 3 hours. Based on the weight ratio of the weight of the dried resin matter remaining on the glass filter to the weight of the sample, the content of the insoluble matter is calculated.

The weight ratio (A/B/C) of the polyester resin (A), the crystalline resin (B), and the noncrystalline linear polyester resin (C) in the toner binder of the present invention is preferably (5 to 90)/(1 to 70)/(0 to 90), more preferably (10 to 85)/(3 to 60)/(5 to 85), and particularly preferably (15 to 80)/(5 to 40)/(10 to 80) from the viewpoint of low-temperature fixing property and hot offset resistance.

The weight ratio (A/B) of the polyester resin (A) to the crystalline resin (B) in the case of using no noncrystalline linear polyester resin (C) is preferably 5/95 to 80/20, more preferably 10/90 to 70/30, and particularly preferably 20/80 to 60/40 from the viewpoint of achieving both of low-temperature fixing property and hot offset resistance.

In the present invention, a method for mixing the polyester resin (A) and the crystalline resin (B) or, in the event that the noncrystalline linear polyester resin (C) is contained, mixing the polyester resin (A), the crystalline resin (B), and the noncrystalline linear polyester resin (C) is not particularly limited, and a known method usually performed may be used, and either powder mixing or melt-mixing is available. Moreover, they may also be mixed during a toner-forming process.

Examples of a mixing device for use in melt-mixing include batch-type mixing devices such as a reaction vessel, and continuous type mixing devices. In order to uniformly mix at an appropriate temperature in a short time, continuous type mixing devices are preferable. Examples of the continuous type mixing devices include an extruder, a continuous kneader, a three-roll mill, and the like.

Examples of the mixing device for use in power mixing include a Henschel mixer, a Nauta mixer, a Banbury mixer, and the like. A Henschel mixer is preferable.

Preferably, the SP value difference (ΔSP value) between the polyester resin (A) and the crystalline resin (B) or, in the event that the noncrystalline linear polyester resin (C) is contained, between the mixture of the (A) and the (C) and the crystalline resin (B) satisfies:

$$\Delta SP\ value \geq 1.5 \qquad \text{formula (3)},$$

in other words, the ΔSP value is 1.5 or more, more preferably 1.7 or more, and particularly preferably 1.8 to 3.0. When it is within this range, the anti-blocking property of the polyester resin becomes good because the crystalline resin (B) disperses with uniform phase separation in the polyester resin (A) or in the mixture of the (A) and the (C).

Preferably, when the glass transition point (° C.) of the polyester resin (A) or, in the event that the noncrystalline linear polyester resin (C) is contained, of the mixture of the (A) and the (C) is represented by (Tg1), and the glass transition point (° C.) of the mixture resulting from the addition of the crystalline resin (B) thereto is represented by (Tg2), (Tg1)−(Tg2) satisfies:

$$(Tg1)-(Tg2) \leq 3°\ C. \qquad \text{formula (4)},$$

in other words, (Tg1)−(Tg2) is 3° C. or less, more preferably 2.7° C. or less. When it is 3° C. or less, the polyester resin is not plasticized by the crystalline resin (B), affording good anti-blocking property.

The toner composition of the present invention contains the toner binder of the present invention, a colorant, and, if necessary, one or more additives selected from among a release agent, a charge controlling agent, a fluidizer, and the like.

As the colorant, all the dyes, pigments, and the like that are used as colorants for use in toner may be used. Specific examples thereof include carbon black, iron black, Sudan black SM, Fast Yellow G, Benzidine Yellow, Pigment Yellow, Indo Fast Orange, Irgazin Red, Paranitroaniline Red, Toluidine Red, Carmine FB, Pigment Orange R, Lake Red 2G, Rhodamine FB, Rhodamine B Lake, Methylviolet B Lake, Phthalocyanine Blue, Pigment Blue, Brilliant Green, Phthalocyanine Green, Oil Yellow GG, Kayaset YG, Orasole Brown B, Oil Pink OP, and the like, and one of them may be used alone, or two or more thereof may be used in combination. Moreover, if necessary, magnetic powder (powder of ferromagnetic metals such as iron, cobalt, and nickel, or compounds such as magnetite, hematite, and ferrite) may be contained therein so as to compatibly function as a colorant.

The content of the colorant is preferably 1 to 40 parts, and more preferably 3 to 10 parts based on 100 parts of the toner binder of the present invention. When the magnetic powder is used, the content thereof is preferably 20 to 150 parts, and more preferably 40 to 120 parts. In the above and in the following, "part" means "part by weight".

As the release agent, those having a softening point [Tm] measured by a flow tester of 50 to 170° C. are preferable, and examples thereof include polyolefin waxes, natural waxes, aliphatic alcohols having 30 to 50 carbon atoms, fatty acids having 30 to 50 carbon atoms, mixtures thereof, and the like.

Examples of the polyolefin waxes include (co)polymers of olefins (e.g., ethylene, propylene, 1-butene, isobutylene, 1-hexene, 1-dodecene, 1-octadecene, mixtures thereof, and the like) [including those obtained by (co)polymerization and thermo-degradation type polyolefins], oxides with oxygen and/or ozone of (co)polymers of olefins, maleic acid-modified products of (co)polymers of olefins [e.g., products which have been modified with maleic acid and derivatives thereof (maleic anhydride, monomethyl maleate, monobutyl maleate, dimethyl maleate, and the like)], copolymers of olefins and unsaturated carboxylic acids [(meth)acrylic acid, itaconic acid, maleic anhydride, and the like] and/or unsaturated carboxylic acid alkyl esters [(meth)acrylic acid alkyl (alkyl group having 1 to 18 carbon atoms) esters and maleic acid alkyl (alkyl group having 1 to 18 carbon atoms) esters, and the like], sasol wax, and the like.

Examples of the natural waxes include carnauba waxes, montan waxes, paraffin waxes, and rice waxes. An example of the aliphatic alcohols having 30 to 50 carbon atoms includes triacontanol. An example of the fatty acids having 30 to 50 carbon atoms includes triacontane carboxylic acid.

Examples of the charge controlling agent include Nigrosine dyes, triphenylmethane dyes having a tertiary amine in the side chain, quaternary ammonium salts, polyamine resins, imidazole derivatives, polymers containing quaternary ammonium salts, azo dyes containing metal, copper phthalocyanine dyes, metal salts of salicylic acid, boron complexes of benzilic acid, polymers containing a sulfonic acid group, fluorine-containing polymers, halogen-substituted aromatic ring-containing polymers, and the like.

Examples of the fluidizer include colloidal silica, alumina powder, titanium oxide powder, and calcium carbonate powder.

In the composition ratio of the toner composition of the present invention, based on the toner weight (in this section, % represents % by weight), the toner binder of the present invention is preferably 30 to 97%, more preferably 40 to 95%, and particularly preferably 45% to 92%; the colorant is preferably 0.05 to 60%, more preferably 0.1 to 55%, and particularly preferably 0.5% to 50%; among additives, the release agent is preferably 0 to 30%, more preferably 0.5 to 20%, and particularly preferably 1% to 10%; the charge controlling agent is preferably 0 to 20%, more preferably 0.1 to 10%, and particularly preferably 0.5% to 7.5%; the fluidizer is preferably 0 to 10%, more preferably 0 to 5%, and particularly preferably 0.1% to 4%. The total content of additives is preferably 3 to 70%, more preferably 4 to 58%, and particularly preferably 5 to 50%. When the composition ratio of the toner falls within the above range, a toner having good electrostatic property can be readily obtained.

The toner composition of the present invention may be obtained by using any of conventionally known methods such as a kneading pulverization method, a phase-inversion emulsion method, and a polymerization method. For example, in the case where a toner is obtained by using the kneading pulverization method, components other than a fluidizer that constitute the toner are dry-blended, then melt-kneaded, then coarsely pulverized, finally formed into fine particles by using a jet mill pulverizer or the like, further classified to form fine particles preferably having a volume average particle size (D50) of 5 to 20 μm, and mixed with a fluidizer, so that the toner can be produced. The particle size (D50) is measured by using a Coulter Counter [e.g., trade name: Multisizer III (manufactured by Coulter, Inc.)].

In the case where a toner is obtained by using the phase-inversion emulsion method, components other than a fluidizer that constitute the toner are dissolved or dispersed in an organic solvent, emulsified by, for example, adding water thereto, and separated and then classified, so that the toner can be produced. The volume average particle size of the toner is preferably 3 to 15 μm.

The toner composition of the present invention is, if necessary, mixed with carrier particles such as iron powders, glass beads, nickel powders, ferrite, magnetite, and ferrite with the surface thereof being coated with a resin (an acrylic resin and a silicone resin, and the like), and used as a developer for an electrostatic latent image. The weight ratio of the toner to the carrier particles is usually 1/99 to 100/0. Moreover, the toner may also be rubbed with a member such as a charging blade in place of the carrier particles, so as to form an electrostatic latent image.

The toner composition of the present invention is fixed on a supporting material (paper, polyester film, and the like) by a copying machine, a printer, or the like, and serves as a recording material. As a method for fixing it onto the supporting material, known methods such as a heat roll fixing method and a flash fixing method may be utilized.

EXAMPLES

The present invention will be described in more detail below by way of examples and comparative examples; however, the present invention is not limited thereto. Hereinafter, "%" represents "% by weight".

Production Example 1

Synthesis of Polyester Resin (A-1)

Into a reaction vessel equipped with a condenser, a stirrer and a nitrogen introducing tube (the reaction vessels used in the production of the following polyester resin (A) also are of the same configuration) were loaded 475 parts (60.5 mol %) of terephthalic acid, 120 parts (15.1 mol %) of isophthalic acid, 105 parts (15.1 mol %) of adipic acid, 300 parts (50.0 mol % with exclusion of 157 parts of the recovery mentioned below) of ethylene glycol, 240 parts (50.0 mol %) of neopentyl glycol, and 0.5 parts of titanium diisopropoxybistriethanol aminate as a polymerization catalyst, and these were allowed to react with one another at 210° C. under a nitrogen gas flow for 5 hours while generated water being distilled off, and then further allowed to react under a reduced pressure of 5 to 20 mmHg for one hour. Subsequently, 7 parts (1.2 mol %) of benzoic acid was added and then allowed to react under normal pressure for 3 hours [linear polyester resin (A-1a)]. Further, to this was added 73 parts (8.0 mol %) of trimellitic anhydride, and after being allowed to react under normal pressure for one hour, these were further allowed to react under a reduced pressure of 20 to 40 mmHg, and then the resulting matter was taken out at a softening point of 145° C. The recovered ethylene glycol was 157 parts.

The resulting resin was cooled to room temperature, and then pulverized into particles. This is defined as a polyester resin (A-1).

The (A-1) had an Mp of 8000, a Tg of 60° C., a Tm of 145° C., an acid value of 26, a hydroxyl value of 1, and an SP value of 11.8.

Mol % within parentheses means mol % of each raw material in a carboxylic acid component or in a polyol component. The same is true for the following description.

Production Example 2

Synthesis of Polyester Resin (A-2)

Into a reaction vessel were loaded 555 parts (68.1 mol %) of terephthalic acid, 125 parts (17.1 mol %) of phthalic anhydride, 1 part (0.1 mol %) of adipic acid, 430 parts (70.0 mol % with exclusion of 225 parts of the recovery mentioned below) of ethylene glycol, 150 parts (30.0 mol %) of neopentyl glycol, and 0.5 parts of titanium diisopropoxybistriethanol aminate as a polymerization catalyst, and these were allowed to react with one another at 210° C. under a nitrogen gas flow for 5 hours while generated water being distilled off, and then further allowed to react under a reduced pressure of 5 to 20 mmHg for one hour. Subsequently, 36 parts (6.0 mol %) of benzoic acid was added and then allowed to react under normal pressure for 3 hours [linear polyester resin (A-2a)]. Further, to this was added 85 parts (8.9 mol %) of trimellitic anhydride, and after being allowed to react under normal pressure for one hour, these were further allowed to react under a reduced pressure of 20 to 40 mmHg, and then the resulting matter was taken out at a softening point of 150° C. The recovered ethylene glycol was 225 parts. The resulting resin was cooled to room temperature, and then pulverized into particles. This is defined as a polyester resin (A-2).

The (A-2) had an Mp of 4500, a Tg of 63° C., a Tm of 150° C., an acid value of 23, a hydroxyl value of 5, and an SP value of 12.1.

Production Example 3

Synthesis of Polyester Resin (A-3)

Into a reaction vessel were loaded 460 parts (2.8 mol) of terephthalic acid, 307 parts (1.8 mol) of isophthalic acid, 695 parts (9.1 mol with exclusion of 216 parts of the recovery mentioned below) of 1,2-propylene glycol, and 3 parts of tetrabutoxy titanate as a condensation catalyst, and these were allowed to react with one another at 210° C. under a nitrogen gas flow for 5 hours while generated water and 1,2-propylene glycol being distilled off, and then further allowed to react under a reduced pressure of 5 to 20 mmHg for one hour. Subsequently, to this was added 52 parts (0.27 mol) of trimellitic anhydride, and after being kept at 180° C. for one hour, the resulting matter was taken out. The recovered 1,2-propylene glycol was 216 parts (2.8 mol). The resin thus taken out was cooled to room temperature, and then pulverized into particles. This is defined as a polyester resin (a-1).

The polyester resin (a-1) had a Tg of 60° C., an Mn of 1700, a hydroxyl value of 79, and an acid value of 50.

Into a reaction vessel were loaded 200 parts (0.07 mol) of the polyester resin (a-1) and 800 parts of tetrahydrofuran, and heated to 80° C., so that the (a-1) was dissolved. To this was added 60 parts (0.27 mol) of isophorone diisocyanate (hereinafter, described as IPDI) under a nitrogen gas flow and allowed to react for 24 hours. To this was further added 23 parts (0.13 mol) of isophorone diamine (hereinafter, described as IPDA), and after being stirred for 3 hours, tetrahydrofuran was distilled off over 10 hours under a reduced pressure of 5 to 20 mmHg while being heated to 200° C., so that the resulting matter was taken out. The resin thus taken out was cooled to room temperature, and then pulverized into particles. This is defined as a polyester resin (A-3).

The polyester resin (A-3) had a Tg of 60° C., a Tm of 145° C., an Mp of 7600, an acid value of 45, a hydroxyl value of 2, and a THF-insoluble matter content of 5%. The equivalent ratio [OH]/[NCO] of a hydroxyl group of the (a-1) to an isocyanate group of IPDI was 1/1.9, the equivalent ratio [NCO]/[$NH_2$] of an unreacted isocyanate group of the reaction product of the (a-1) and IPDI to an amino group of IPDA was 1/1, the total content of the constituent units of polyisocyanate and polyamine in the polyester resin (A-3) was 20.9%, the mole ratio of urethane group/urea group was 1.2/1 and the SP value was 12.4.

Production Example 4

Synthesis of Polyester Resin (A-4)

Into a reaction vessel were loaded 384 parts (45.5 mol %) of terephthalic acid, 384 parts (45.5 mol %) of isophthalic acid, 573 parts of ethylene glycol, and 0.5 parts of tetrabutoxy titanate as a polymerization catalyst, and these were allowed to react with one another at 210° C. under a nitrogen gas flow for 5 hours while generated water and ethylene glycol being distilled off, and then further allowed to react under a reduced pressure of 5 to 20 mmHg for one hour. Subsequently, to this was added 88 parts (9.1 mol %) of trimellitic anhydride, and after being allowed to react under normal pressure for one hour, these were further allowed to react under a reduced pressure of 20 to 40 mmHg, and then the resulting matter was taken out at a softening point of 140° C. The recovered ethylene glycol was 245 parts. The resulting resin was cooled to room temperature, and then pulverized into particles. This is defined as a polyester resin (A-4).

The polyester resin (A-4) had a Tg of 60° C., a Tm of 140° C., an Mp of 6000, an acid value of 27, a hydroxyl value of 1, a THF-insoluble matter content of 3%, and an SP value of 12.2.

Production Example 5

Synthesis of Polyester Resin (A-5)

Into a reaction vessel were loaded 440 parts (54.7 mol %) of terephthalic acid, 235 parts (28.3 mol %) of isophthalic acid, 7 parts (1.0 mol %) of adipic acid, 30 parts (5.1 mol %) of benzoic acid, 554 parts of ethylene glycol, and 0.5 parts of tetrabutoxy titanate as a polymerization catalyst, and these were allowed to react with one another at 210° C. under a nitrogen gas flow for 5 hours while generated water and ethylene glycol being distilled off, and then further allowed to react under a reduced pressure of 5 to 20 mmHg for one hour. Subsequently, to this was added 103 parts (10.9 mol %) of trimellitic anhydride, and after being allowed to react under normal pressure for one hour, these were further allowed to react under a reduced pressure of 20 to 40 mmHg, and then the resulting matter was taken out at a softening point of 138° C. The recovered ethylene glycol was 219 parts. The resulting resin was cooled to room temperature, and then pulverized into particles. This is defined as a polyester resin (A-5).

The polyester resin (A-5) had a Tg of 56° C., a Tm of 138° C., an Mp of 4900, an acid value of 35, a hydroxyl value of 28, a THF-insoluble matter content of 5%, and an SP value of 12.4.

Production Example 6

Synthesis of Polyester Resin (A-6)

Into a reaction vessel were loaded 567 parts (68.0 mol %) of terephthalic acid, 243 parts (30.0 mol %) of isophthalic acid, 605 parts (85.0 mol % with exclusion of 334 parts of the recovery mentioned below) of ethylene glycol, 80 parts (15.0 mol %) of neopentyl glycol, and 0.5 parts of titanium diisopropoxybistriethanol aminate, and these were allowed to react with one another at 210° C. under a nitrogen gas flow for 5 hours while generated water and ethylene glycol being distilled off. Subsequently, to this was added 16 parts (2.0 mol %) of trimellitic anhydride, and after being allowed to react under normal pressure for one hour, these were further allowed to react under a reduced pressure of 20 to 40 mmHg, and then the resulting matter was taken out at a softening point of 138° C. The recovered ethylene glycol was 334 parts. The resulting resin was cooled to room temperature, and then pulverized into particles. This is defined as a polyester resin (A-6).

The polyester resin (A-6) had a Tg of 61° C., a Tm of 138° C., an Mp of 17000, an acid value of 1, a hydroxyl value of 14, a THF-insoluble matter content of 3%, and an SP value of 12.1.

Production Example 7

Synthesis of Polyester Resin (A-7)

Into a reaction vessel were loaded 420 parts (61.3 mol %) of terephthalic acid, 180 parts (25.8 mol %) of isophthalic acid, 409 parts (85.0 mol % with exclusion of 187 parts of the recovery mentioned below) of ethylene glycol, 220 parts (15.0 mol %) of an adduct of bisphenol A with 2 mol of propylene oxide, and 0.5 parts of titanium diisopropoxybistriethanol aminate, and these were allowed to react with one another at 210° C. under a nitrogen gas flow for 5 hours while generated water and ethylene glycol being distilled off, and then further allowed to react under a reduced pressure of 5 to 20 mmHg for one hour. Subsequently, to this was added 106 parts (12.9 mol %) of trimellitic anhydride, and after being allowed to react under normal pressure for one hour, these were further allowed to react under a reduced pressure of 20 to 40 mmHg, and then the resulting matter was taken out at a softening point of 150° C. The recovered ethylene glycol was 187 parts. The resulting resin was cooled to room temperature, and then pulverized into particles. This is defined as a polyester resin (A-7).

The polyester resin (A-7) had a Tg of 60° C., a Tm of 150° C., an Mp of 6000, an acid value of 1, a hydroxyl value of 40, a THF-insoluble matter content of 21%, and an SP value of 12.0.

Production Example 8

Production of Crystalline Part b

Into a reaction vessel equipped with a condenser tube, a stirrer and a nitrogen introducing tube were loaded 159 parts of sebacic acid, 28 parts of adipic acid, 124 parts of 1,4-butanediol, and 1 part of titanium dihydroxybis(triethanol aminate) as a condensation catalyst, and these were allowed to react with one another at 180° C. under a nitrogen gas flow for 8 hours while generated water was distilled off. Subsequently, these were allowed to react under a nitrogen gas flow for 4 hours while the temperature was gradually raised to 220° C. and generated water and 1,4-butanediol were distilled off, and then further allowed to react under a reduced pressure of 5 to 20 mmHg, and then the resulting matter was taken out at the time when the Mw reached 10000. The resin taken out was cooled to room temperature, and then pulverized into particles to obtain a crystalline polycondensation polyester resin [crystalline part b1]. The [crystalline part b1] had a melting point of 55° C., an Mw of 10000, a hydroxyl value of 36, and an SP value of 10.1.

Production Example 9

Production of Crystalline Part b

Into a reaction vessel equipped with a condenser tube, a stirrer and a nitrogen introducing tube were loaded 286 parts of dodecane diacid, 159 parts of 1,6-hexanediol and 1 part of titanium dihydroxybis(triethanol aminate) as a condensation catalyst, and these were allowed to react with one another at 170° C. under a nitrogen gas flow for 8 hours while generated water was distilled off. Subsequently, these were allowed to react under a nitrogen gas flow for 4 hours while the temperature was gradually raised to 220° C. and generated water was distilled off, and then further allowed to react under a reduced pressure of 5 to 20 mmHg, and then the resulting matter was taken out at the time when the Mw reached 10000. The resin taken out was cooled to room temperature, and then pulverized into particles to obtain a crystalline polycondensation polyester resin [crystalline part b2]. The [crystalline part b2] had a melting point of 65° C., an Mw of 10000, a hydroxyl value of 36, and an SP value of 9.6.

Production Example 10

Production of Crystalline Part b

Into a reaction container equipped with a stirring apparatus and a dewatering apparatus were loaded 2 parts of 1,4-butanediol, 650 parts of ε-caprolactone, and 2 parts of dibutyl tin oxide, and these were allowed to react with one another at 150° C. at normal pressure and under a nitrogen atmosphere for 10 hours. Further, the resulting resin was cooled to room temperature, and then pulverized into particles to obtain a crystalline polyester resin [crystalline part b3], which was a lactone ring-opening polymer. The [Crystalline part b3] had a melting point of 60° C., an Mw of 9800, a hydroxyl value of 14, and an SP value of 10.2.

Production Example 11

Production of Crystalline Part b

Into a reaction vessel equipped with a condenser tube, a stirrer and a nitrogen introducing tube were loaded 874 parts of sebacic acid, 282 parts of ethylene glycol, and 1 part of titanium dihydroxybis(triethanol aminate) as a condensation catalyst, and these were allowed to react with one another at 180° C. under a nitrogen gas flow for 8 hours while generated water was distilled off. Subsequently, these were allowed to react under a nitrogen gas flow for 4 hours while the temperature was gradually raised to 220° C. and generated water and ethylene glycol were distilled off, and then further allowed to react under a reduced pressure of 5 to 20 mmHg, and then the resulting matter was taken out at the time when the Mw reached 14000. The resin taken out was cooled to room temperature, and then pulverized into particles to obtain a crystalline polycondensation polyester resin [crystalline part b4]. The [crystalline part b4] had a melting point of 74° C., an Mw of 14000, a hydroxyl value of 24, and an SP value of 10.2.

Production Example 12

Production of Crystalline Part b

Into a reaction vessel equipped with a condenser tube, a stirrer and a nitrogen introducing tube were loaded 684 parts of sebacic acid, 437 parts of 1,6-hexanediol, and 0.5 parts of tetrabutoxy titanate as a condensation catalyst, and these were allowed to react with one another at 170° C. under a nitrogen gas flow for 8 hours while generated water was distilled off. Subsequently, these were allowed to react under a nitrogen gas flow for 4 hours while the temperature was gradually raised to 220° C. and generated water was distilled off, and then further allowed to react under a reduced pressure of 5 to 20 mmHg, and then the resulting matter was taken out at the time when the Mw reached 13500. The resin taken out was cooled to room temperature, and then pulverized into particles to obtain a crystalline polycondensation polyester resin [crystalline part b5]. The [crystalline part b5] had a melting point of 67° C., an Mw of 13500, a hydroxyl value of 28, and an SP value of 9.8.

Production Example 13

Production of Crystalline Resin B

Into a reaction container equipped with a stirring rod and a thermometer were charged 44 parts of tolylene diisocyanate and 100 parts of MEK. This solution was charged with 32 parts of cyclohexanedimethanol and allowed to react at 80° C. for 2 hours. Subsequently, the obtained solution of a noncrystalline polyurethane resin [noncrystalline part c1] having an isocyanate group at its terminal was put into a solution obtained by dissolving 140 parts of the [crystalline part b1] in 140 parts of MEK, and allowed to react at 80° C. for 4 hours to obtain a solution of a [crystalline resin B-1] composed of a crystalline part and a noncrystalline part in MEK. The [crystalline resin B-1] after removing the solvent had a Tb of 55° C., an Mn of 14000, an Mw of 28000, an SP value of 10.3, and a pencil hardness of 2B.

Production Example 14

Production of Crystalline Resin B

Into a reaction container equipped with a stirring rod and a thermometer were charged 38 parts of tolylene diisocyanate and 100 parts of MEK. This solution was charged with 14 parts of propylene glycol and allowed to react at 80° C. for 2 hours. Subsequently, the obtained solution of a noncrystalline polyurethane resin [noncrystalline part c2] having an isocyanate group at its terminal was put into a solution obtained by dissolving 130 parts of the [crystalline part b2] in 130 parts of MEK, and allowed to react at 80° C. for 4 hours to obtain a solution of a [crystalline resin B-2] composed of a crystalline part and a noncrystalline part in MEK. The [crystalline resin B-2] after removing the solvent had a Tb of 64° C., an Mn of 9000, an Mw of 34000, an SP value of 9.8, and a pencil hardness of B.

Production Example 15

Production of Crystalline Resin B

Into a reaction container equipped with a stirring rod and a thermometer were charged 38 parts of tolylene diisocyanate and 100 parts of MEK. This solution was charged with 28 parts of cyclohexane dimethanol and allowed to react at 80° C. for 2 hours. Subsequently, the obtained solution of a noncrystalline polyurethane resin [noncrystalline part c3] having an isocyanate group at its terminal was put into a solution obtained by dissolving 250 parts of the [crystalline part b3] in 250 parts of MEK, and allowed to react at 80° C. for 4 hours to obtain a solution of a [crystalline resin B-3] composed of a crystalline part and a noncrystalline part in MEK. The [crystalline resin B-3] after removing the solvent had a Tb of 59° C., an Mn of 10000, an Mw of 22000, an SP value of 10.4, and a pencil hardness of 2B.

Production Example 16

Production of Crystalline Resin B

Into a reaction container equipped with a stirring apparatus, a heating and cooling apparatus, a thermometer, a dropping funnel, and a nitrogen blowing tube was charged 500 parts of toluene, and into a separate glass beaker were charged 350 parts of toluene, 120 parts of behenyl acrylate (an acrylate of an alcohol having a linear alkyl group with 22 carbon atoms: Blemmer VA (produced by NOF CORPORATION)), 20 parts of 2-ethylhexyl acrylate, 10 parts of methacrylic acid, and 7.5 parts of azobisisobutylonitrile (AIBN), and these were stirred and mixed at 20° C. to prepare a monomer solution, which was then charged into the dropping funnel. After replacing the gas phase part of the reaction container with nitrogen, the monomer solution was dropped at 80° C. over 2 hours in a hermetically-sealed condition, and aged at 85° C. for 2 hours from the end of the dropping, and then toluene was removed at 130° C. under reduced pressure for 3 hours to obtain a [crystalline resin B-4], which was a crystalline vinyl resin. The [crystalline resin B-4] had a Tb of 56° C., an Mn of 68000, an Mw of 89000, an SP value of 9.6, and a pencil hardness of 3B.

Production Example 17

Production of Crystalline Resin B

Into a reaction vessel equipped with a stirrer and a nitrogen introduction tube was charged 240 parts of the [crystalline part b4], which was then dissolved homogeneously at 100° C. Further, 11 parts of 4,4'-diphenylmethane diisocyanate was charged and then allowed to react at 100° C. for 3 hours to obtain a [crystalline resin B-5]. The [crystalline resin B-5]

had a Tb of 71° C., an Mn of 14800, an Mw of 76200, an SP value of 10.3, and a pencil hardness of B.

Production Example 18

Production of Crystalline Resin B

Into a reaction vessel equipped with a stirrer and a nitrogen introduction tube was charged 385 parts of the [crystalline part b5], which was then dissolved homogeneously at 100° C. Further, 15 parts of hexamethylene diisocyanate was charged and then allowed to react at 100° C. for 3 hours to obtain a [crystalline resin B-6]. The [crystalline resin B-6] had a Tb of 66° C., an Mn of 14800, an Mw of 76200, an SP value of 10.0, and a pencil hardness of HB.

Production Example 19

Synthesis of Noncrystalline Linear Polyester Resin (C-1)

Into a reaction vessel equipped with a condenser tube, a stirrer, and a nitrogen introduction tube were loaded 526 parts (65.0 mol %) of terephthalic acid, 225 parts (28.0 mol %) of isophthalic acid, 43 parts (7.0 mol %) of benzoic acid, 561 parts (85.0 mol % with exclusion of 307 parts of the recovery mentioned below) of ethylene glycol, 75 parts (15.0 mol %) of neopentyl glycol, and 2 parts of titanium diisopropoxybis-triethanol aminate as a polymerization catalyst, and these were allowed to react with one another at 210° C. under a nitrogen gas flow for 5 hours while generated water being distilled off, then further allowed to react under a reduced pressure of 5 to 20 mmHg for one hour, and subsequently allowed to react under normal pressure for 3 hours. Further, 43 parts (5.0 mol %) of trimellitic anhydride was added and then allowed to react under normal pressure for one hour. The recovered ethylene glycol was 307 parts. The resulting resin was cooled to room temperature, and then pulverized into particles. This is defined as a polyester resin (C-1).

The (C-1) had an Mp of 7000, a Tg of 61° C., a Tm of 111° C., an acid value of 24, a hydroxyl value of 2.4, and an SP value of 12.0.

Production Example 20

Synthesis of Noncrystalline Linear Polyester Resin (C-2)

Into a reaction vessel equipped with a condenser tube, a stirrer, and a nitrogen introduction tube were loaded 440 parts (66.0 mol %) of terephthalic acid, 189 parts (28.0 mol %) of isophthalic acid, 27 parts (6.0 mol %) of benzoic acid, 431 parts (85.0 mol % with exclusion of 210 parts of the recovery mentioned below) of ethylene glycol, 219 parts (15.0 mol %) of an adduct of bisphenol A with 2 mol of propylene oxide, and 2 parts of titanium diisopropoxybistriethanol aminate as a polymerization catalyst, and these were allowed to react with one another at 210° C. under a nitrogen gas flow for 5 hours while generated water being distilled off, then further allowed to react under a reduced pressure of 5 to 20 mmHg for one hour, and subsequently allowed to react under normal pressure for 3 hours. Further, 43 parts (5.0 mol %) of trimellitic anhydride was added and then allowed to react under normal pressure for one hour. The recovered ethylene glycol was 210 parts. The resulting resin was cooled to room temperature, and then pulverized into particles. This is defined as a polyester resin (C-2).

The (C-2) had an Mp of 5800, a Tg of 59° C., a Tm of 104° C., an acid value of 25, a hydroxyl value of 12, and an SP value of 11.8.

Comparative Production Example 1

Synthesis of Polyester Resin (RA-1)

Into a reaction vessel were loaded 41 parts (10.2 mol %) of an adduct of bisphenol A with 2 mol of ethylene oxide, 457 parts (89.1 mol %) of an adduct of bisphenol A with 3 mol of propylene oxide, 9 parts (0.8 mol %) of an adduct of phenol novolak (average number of functional groups: 5.6) with 6 mol of propylene oxide, 166 parts (49.8 mol %) of terephthalic acid, 93 parts (39.8 mol %) of fumaric acid, and 3 parts of tetrabutoxy titanate as a condensation catalyst, and these were allowed to react with one another at 230° C. under a nitrogen gas flow for 5 hours while generated water being distilled off. Subsequently, these were allowed to react under a reduced pressure of 5 to 20 mmHg, and at the time when its acid value reached 2 or less, the system was cooled to 180° C., and to this was then added 41 parts (10.4 mol %) of trimellitic anhydride, and after being allowed to react in a hermetically-sealed condition under normal pressure for 2 hours, this was further allowed to react at 230° C. under a reduced pressure of 5 to 20 mmHg, and the resulting matter was taken out at a softening point of 135° C. The resin taken out was cooled to room temperature, and then pulverized into particles. This is defined as a polyester resin (RA-1).

The polyester resin (RA-1) had a Tg of 58° C., a Tm of 135° C., an Mp of 11300, an acid value of 20, a hydroxyl value of 5, a THF-insoluble matter content of 6%, and an SP value of 10.9.

Comparative Production Example 2

Synthesis of Polyester Resin (RA-2)

Into a reaction vessel were loaded 486 parts (80.7 mol %) of an adduct of bisphenol A with 3 mol of propylene oxide, 23 parts (19.3 mol %) of an adduct of phenol novolak (average number of functional groups: 5.6) with 6 mol of propylene oxide, 166 parts (82.6 mol %) of terephthalic acid, and 3 parts of tetrabutoxy titanate as a condensation catalyst, and these were allowed to react with one another at 230° C. under a nitrogen gas flow for 5 hours while generated water being distilled off. Subsequently, these were allowed to react under a reduced pressure of 5 to 20 mmHg, and at the time when its AV reached 2 or less, the system was cooled to 180° C., and to this was then added 40 parts (17.4 mol %) of trimellitic anhydride, and after being allowed to react in a hermetically-sealed condition under normal pressure for 2 hours, this was further allowed to react at 230° C. under a reduced pressure of 5 to 20 mmHg, and the resulting matter was taken out at a softening point of 145° C. The resin thus taken out was cooled to room temperature, and then pulverized into particles. This is defined as a polyester resin (RA-2).

The polyester resin (RA-2) had a Tg of 57° C., a Tm of 145° C., an Mp of 8300, an acid value of 20, a hydroxyl value of 18, a THF-insoluble matter content of 28%, and an SP value of 10.8.

Comparative Production Example 3

Synthesis of Polyester Resin (RA-3)

Into a reaction vessel were loaded 259 parts (59.0 mol %) of terephthalic acid, 154 parts (39.3 mol %) of phthalic anhydride, 137 parts (40.0 mol % with exclusion of 68 parts of the recovery mentioned below) of ethylene glycol, 583 parts (60.0 mol %) of an adduct of bisphenol A with 2 mole of propylene oxide, and 0.5 parts of titanium diisopropoxybistriethanol aminate, and these were allowed to react with one another at 210° C. under a nitrogen gas flow for 5 hours while generated water and ethylene glycol being distilled off. Subsequently, to this was added 7 parts (1.7 mol %) of trimellitic anhydride, and after being allowed to react under normal pressure for one hour, these were further allowed to react under a reduced pressure of 20 to 40 mmHg, and then the resulting matter was taken out at a softening point of 130° C. The recovered ethylene glycol was 68 parts. The resulting resin was cooled to room temperature, and then pulverized into particles. This is defined as a polyester resin (RA-3).

The polyester resin (RA-3) had a Tg of 61° C., a Tm of 130° C., an Mp of 14500, an acid value of 1, a hydroxyl value of 14, a THF-insoluble matter content of 2%, and an SP value of 11.4.

Comparative Production Example 4

Production of Crystalline Resin (RB-1)

Into a reaction container equipped with a stirring rod and a thermometer were charged 47 parts of tolylene diisocyanate and 120 parts of MEK. This solution was charged with 33 parts of cyclohexanedimethanol and allowed to react at 80° C. for 2 hours. Subsequently, the obtained solution of a noncrystalline polyurethane resin [noncrystalline part c1] having an isocyanate group at its terminal was put into a solution obtained by dissolving 120 parts of the [crystalline part b1] in 120 parts of MEK, and allowed to react at 80° C. for 4 hours to obtain a solution of a [crystalline resin RB-1] composed of a crystalline part and a noncrystalline part in MEK. The [crystalline resin RB-1] after removing the solvent had a Tb of 54° C., an Mn of 24000, an Mw of 59000, an SP value of 10.5, and a pencil hardness of B.

Main physical property values measured by the methods described above of the polyester resin (A), polyester resin (RA), crystalline resin (B), and crystalline resin (RB) are shown in Table 1 and Table 2. In Table 1 and Table 2, the exponent of 10 was indicated not by a superscript but by a number with a symbol ^. For example, $10^3$ was represented by 10^3.

TABLE 1

| | Production Example 1 | Production Example 2 | Production Example 3 | Production Example 4 | Production Example 5 | Production Example 6 | Production Example 7 | Comparative Production Example 1 | Comparative Production Example 2 | Comparative Production Example 3 |
|---|---|---|---|---|---|---|---|---|---|---|
| Resin | A-1 | A-2 | A-3 | A-4 | A-5 | A-6 | A-7 | RA-1 | RA-2 | RA-3 |
| Mp | 8000 | 4500 | 7600 | 6000 | 4900 | 17000 | 6000 | 11300 | 8300 | 14500 |
| Tg [° C.] | 60 | 63 | 60 | 60 | 56 | 61 | 60 | 58 | 57 | 61 |
| Tm [° C.] | 145 | 150 | 145 | 140 | 138 | 138 | 150 | 135 | 145 | 130 |
| Acid value | 26 | 23 | 45 | 27 | 35 | 1 | 1 | 20 | 20 | 1 |
| Hydroxyl value | 1 | 5 | 2 | 1 | 28 | 14 | 40 | 5 | 18 | 14 |
| SP value | 11.8 | 12.1 | 12.4 | 12.2 | 12.4 | 12.1 | 12.0 | 10.9 | 10.8 | 11.5 |
| [G'(150)] of (A) [Pa] | 6.0 × 10^3 | 2.0 × 10^3 | 5.0 × 10^3 | 3.3 × 10^3 | 2.0 × 10^3 | 6.9 × 10^3 | 2.8 × 10^3 | 8.8 × 10^2 | 1.1 × 10^3 | 1.2 × 10^3 |
| Eta[Tg + 40] of (A) [Pa · s] | 5.5 × 10^5 | 3.2 × 10^5 | 5.0 × 10^5 | 4.0 × 10^5 | 5.0 × 10^5 | 6.8 × 10^5 | 3.2 × 10^5 | 6.0 × 10^5 | 4.2 × 10^5 | 4.1 × 10^5 |
| [G'(150)]/[G'(180)]of (A) | 8 | 6 | 10 | 13 | 4 | 8 | 4 | 21 | 23 | 19 |

TABLE 2

| | Production Example 13 | Production Example 14 | Production Example 15 | Production Example 16 | Production Example 17 | Production Example 18 | Comparative Production Example 4 |
|---|---|---|---|---|---|---|---|
| Resin | B-1 | B-2 | B-3 | B-4 | B-5 | B-6 | RB-1 |
| Crystalline part | b1 | b2 | b3 | — | b4 | b5 | b1 |
| Mw | 28000 | 34000 | 89000 | 33000 | 58000 | 76000 | 59000 |
| Tb [° C.] | 55 | 71 | 61 | 53 | 71 | 66 | 54 |
| Melt initiation temperature X [° C.] | 48 | 62 | 56 | 43 | 62 | 58 | 40 |
| Tm/Tb | 0.97 | 1.04 | 1.08 | 1.06 | 1.07 | 1.05 | 1.6 |
| SP value | 10.3 | 9.8 | 10.6 | 9.6 | 10.3 | 10.0 | 10.5 |
| Pencil hardness | 2B | B | 2B | 3B | B | HB | B |
| G'(Tb + 20) [Pa] | 4.5 × 10^3 | 6.9 × 10^3 | 1.2 × 10^2 | 6.4 × 10^3 | 5.8 × 10^4 | 7.2 × 10^4 | 2.1 × 10^5 |
| \|logG''(X + 20) − logG''(X)\| | 3.6 | 3.4 | 4.2 | 3.7 | 2.6 | 2.7 | 1.8 |
| G''(Tb + 30)/G''(Tb + 70) | 6.4 | 3.4 | 24 | 7.1 | 2.3 | 1.8 | 21 |
| n in the binding form between (b) and (c) | 1.09 | 1.18 | 0.96 | — | — | — | 4.15 |

Examples 1 to 15, Comparative Examples 1 to 4

The polyester resins (A-1) to (A-7), crystalline resins (B-1) to (B-6), noncrystalline linear polyester resins (C-1) to (C-2) obtained in the above-described production examples and the polyester resins (RA-1) to (RA-3) and (RB-1) obtained in the comparative production examples were blended in accordance with the blending ratios (parts) shown in Table 3, so that toner binders of the present invention and comparative toner binders were obtained, and these were formed into toners by using the following manner.

First, 8 parts of carbon black MA-100 [produced by Mitsubishi Chemical Inc.], 5 parts of carnauba wax, and 1 part of a charge controlling agent T-77 [produced by Hodogaya Chemical Co., Ltd.], then preliminarily mixed with a Henschel mixer [FM10B manufactured by Mitsui Miike Chemical Engineering Machinery, Co., Ltd.], and then kneaded with a twin screw kneader [PCM-30 manufactured by Ikegai Corp.]. Subsequently, after being finely pulverized with a supersonic jet pulverizer Labo Jet [manufactured by Nippon Pneumatic Mfg. Co., Ltd.], the resulting particles were classified with an airflow classifier [MDS-1, manufactured by Nippon Pneumatic Mfg. Co., Ltd.], so that toner particles having a particle size D50 of 8 μm were obtained. Subsequently, 0.5 parts of colloidal silica (Aerosil R972; produced by Nippon Aerosil Co., Ltd.) was added to 100 parts of the toner particles and mixed in a sample mill, so that toner compositions (T-1) to (T-15) of the present invention and comparative toner compositions (RT-1) to (RT-4) were obtained.

The results of evaluations made by the following evaluation methods are shown in Table 3. Each blank cell in Table 3 indicates that the material corresponding thereto was not blended.

TABLE 3

| Raw material | | | Example 1 T-1 | Example 2 T-2 | Example 3 T-3 | Example 4 T-4 | Example 5 T-5 | Example 6 T-6 | Example 7 T-7 | Example 8 T-8 | Example 9 T-9 | Example 10 T-10 |
|---|---|---|---|---|---|---|---|---|---|---|---|---|
| Production Example | 1 | A-1 | 30 | | | | | 30 | | 30 | 30 | 60 |
| | 2 | A-2 | | 30 | | | | | 30 | | | |
| | 3 | A-3 | | | 30 | | | | | | | |
| | 4 | A-4 | | | | 30 | | | | | | |
| | 5 | A-5 | | | | | 30 | | | | | |
| | 6 | A-6 | | | | | | | | | | |
| | 7 | A-7 | | | | | | | | | | |
| | 13 | B-1 | 70 | 70 | 70 | 70 | 70 | | | | | 40 |
| | 14 | B-2 | | | | | | 70 | | | | |
| | 15 | B-3 | | | | | | | 70 | | | |
| | 16 | B-4 | | | | | | | | 70 | | |
| | 17 | B-5 | | | | | | | | | 70 | |
| | 18 | B-6 | | | | | | | | | | |
| | 19 | C-1 | | | | | | | | | | |
| | 20 | C-2 | | | | | | | | | | |
| Comparative Production Example | 1 | RA-1 | | | | | | | | | | |
| | 2 | RA-2 | | | | | | | | | | |
| | 3 | RA-3 | | | | | | | | | | |
| | 4 | RB-1 | | | | | | | | | | |
| Carbon black MA-100 | | | 8 | 8 | 8 | 8 | 8 | 8 | 8 | 8 | 8 | 8 |
| Carnauba wax | | | 5 | 5 | 5 | 5 | 5 | 5 | 5 | 5 | 5 | 5 |
| charge controlling agent T-77 | | | 1 | 1 | 1 | 1 | 1 | 1 | 1 | 1 | 1 | 1 |
| Δ SP value | | | 1.5 | 1.8 | 2.1 | 1.9 | 2.1 | 2.0 | 1.5 | 2.2 | 1.5 | 1.5 |
| (Tg1) − (Tg2) [° C.] | | | 2.7 | 2.5 | 0.2 | 2.3 | 0.3 | 0.4 | 2.4 | 0.2 | 2.6 | 2.4 |
| MFT | | | 90 | 90 | 90 | 90 | 95 | 90 | 95 | 95 | 90 | 100 |
| Hot Offset Generation Temperature [° C.] | | | 185 | 195 | 185 | 180 | 185 | 185 | 185 | 185 | 185 | 200 |
| Fixing temperature range [° C.] | | | 95 | 105 | 95 | 90 | 90 | 95 | 90 | 90 | 95 | 100 |
| Anti-blocking property of toner | | | ⊙ | ⊙ | ⊙ | ⊙ | ⊙ | ⊙ | ⊙ | ⊙ | ⊙ | ⊙ |

| Raw material | | | Example 11 T-11 | Example 12 T-12 | Example 13 T-13 | Example 14 T-14 | Example 15 T-15 | Comparative Example 1 RT-1 | Comparative Example 2 RT-2 | Comparative Example 3 RT-3 | Comparative Example 4 RT-4 |
|---|---|---|---|---|---|---|---|---|---|---|---|
| Production Example | 1 | A-1 | | | | | | | | | |
| | 2 | A-2 | | | | | | | | | 30 |
| | 3 | A-3 | | | | | | | | | |
| | 4 | A-4 | | | | | | | | | |
| | 5 | A-5 | | | | | | | | | |
| | 6 | A-6 | 50 | 50 | 20 | 20 | | | | | |
| | 7 | A-7 | | | | | 20 | | | | |
| | 13 | B-1 | | | | | | 70 | 70 | 70 | |
| | 14 | B-2 | | | | 5 | | | | | |
| | 15 | B-3 | | | | | | | | | |

TABLE 3-continued

| | | | | | | | | | | |
|---|---|---|---|---|---|---|---|---|---|---|
| | 16 | B-4 | | | | | | | | |
| | 17 | B-5 | | | | | | | | |
| | 18 | B-6 | 10 | 5 | 10 | | 20 | | | |
| | 19 | C-1 | 40 | | 70 | | 60 | | | |
| | 20 | C-2 | | 45 | | 75 | | | | |
| Comparative Production Example | 1 | RA-1 | | | | | | 30 | | |
| | 2 | RA-2 | | | | | | | 30 | |
| | 3 | RA-3 | | | | | | | | 30 |
| | 4 | RB-1 | | | | | | | | 70 |
| Carbon black MA-100 | | | 8 | 8 | 8 | 8 | 8 | 8 | 8 | 8 | 8 |
| Carnauba wax | | | 5 | 5 | 5 | 5 | 5 | 5 | 5 | 5 | 5 |
| charge controlling agent T-77 | | | 1 | 1 | 1 | 1 | 1 | 1 | 1 | 1 | 1 |
| Δ SP value | | | 2.1 | 2.0 | 1.9 | 2.1 | 1.8 | 0.6 | 0.5 | 1.2 | 1.6 |
| (Tg1) − (Tg2) [° C.] | | | 0.4 | 0.3 | 1.6 | 1.8 | 2 | 24.9 | 26.5 | 6.9 | 2.4 |
| MFT | | | 100 | 105 | 95 | 100 | 95 | 105 | 110 | 105 | 120 |
| Hot Offset Generation Temperature [° C.] | | | 225 | 230 | 210 | 220 | 215 | 145 | 150 | 145 | 185 |
| Fixing temperature range [° C.] | | | 125 | 125 | 115 | 120 | 120 | 40 | 40 | 40 | 65 |
| Anti-blocking property of toner | | | ⊙ | ⊙ | ⊙ | ⊙ | ⊙ | X | X | X | ○ |

[Evaluation Method]

[1] Minimum Fixing Temperature (MFT)

Unfixed images developed by using a commercial copying machine (AR5030: manufactured by Sharp Corporation) were evaluated by using a fixing device of the commercial copying machine (AR5030: manufactured by Sharp Corporation). The lowest temperature at which the residual rate of the image density after rubbing a fixed image with a pad became 70% or more was determined as the minimum fixing temperature.

[2] Hot Offset Generation Temperature (HOT)

The fixed state was evaluated in the same manner as in the MFT described above, and the presence or absence of hot offset on a fixed image was visually evaluated. The highest temperature at which no hot offset generated after a passage of a fixing roll was determined as hot offset generation temperature.

HOT-MFT (HOT minus MFT) was described as a fixing temperature range (° C.).

[3] Anti-Blocking Property Test of Toner

The toner composition was moistened for 48 hours under a high temperature and humidity environment of 50° C. and 85% R.H. Under the same environment, the blocking state of the developer was visually determined, and the image quality of a copy obtained by using a commercial copying machine (AR5030: manufactured by Sharp Corporation) was observed.

Evaluation Criteria

⊙: No toner blocking was observed, and good image quality was obtained even after copying processes of 3000 sheets.

○: Although no toner blocking was observed, slight disturbances were observed after copying processes of 3000 sheets.

x: Toner blocking was visually observed, and no images were obtainable before copying processes reaches 3000 sheets.

INDUSTRIAL APPLICABILITY

The toner composition and toner binder of the present invention are useful as a toner and a toner binder for electrostatically charged image development to be used for electrophotography, electrostatic recording, electrostatic printing, and the like, the toner and the toner binder being superior in low-temperature fixing property, hot offset resistance, and anti-blocking property.

The invention claimed is:

1. A toner binder comprising a polyester resin (A) comprising at least a carboxylic acid component (x) and a polyol component (y) as constituent units, the carboxylic acid component (x) containing 80% by mol or more in total of two or more dicarboxylic acids (x1) selected from among aromatic dicarboxylic acids and ester-forming derivatives thereof, and also containing at least a polycarboxylic acid having three or more carboxyl groups (x2), and the polyol component (y) containing 50% by mol or more of an aliphatic diol (y1) having 2 to 10 carbon atoms, wherein the polyester resin (A) has a storage modulus at 150° C. [G'(150)] of 2000 Pa or more, and [G'(150)] and a storage modulus at 180° C. [G'(180)] satisfy the formula (1) given below; a crystalline resin (B) that has a maximum peak temperature [Tb] of heat of melting of 40 to 100° C., a ratio [Tm/Tb] of a softening point [Tm] to [Tb] of 0.8 to 1.55, and a melt initiation temperature [X] being within the temperature range of (Tb±30)° C., wherein a storage modulus G'(Tb+20) at (Tb +20)° C. as well as a loss modulus G"(X+20) at (X+20)° C. and a loss modulus G"(X) at X° C. each satisfy Condition 1 and Condition 2 defined below; and, if necessary, a noncrystalline linear polyester resin (C):

$$[G'(150)]/[G'(180)] \leq 15 \quad \text{formula (1)}$$

$$G'(Tb+20)=50 \text{ to } 1\times10^6 \text{ Pa} \quad \text{[Condition 1]}$$

$$|\log G''(X+20)-\log G''(X)|>2.0. \quad \text{[Condition 2]}$$

2. The toner binder according to claim 1, wherein the dicarboxylic acids (x1) constituting the polyester resin (A) are two or more selected from the group consisting of the following (1) to (3):

(1) terephthalic acid and/or ester-forming derivatives thereof, (2) isophthalic acid and/or ester-forming derivatives thereof, and (3) phthalic acid and/or ester-forming derivatives thereof.

3. The toner binder according to claim 1, wherein the polyester resin (A) has a glass transition point (Tg) of 30 to 75° C. and viscosity Eta[Tg+40] at Tg+40° C. satisfies the following formula (2):

$$Eta[Tg+40] \leq 7\times10^5 \text{ Pa·s} \qquad \text{formula (2).}$$

4. The toner binder according to claim 1, wherein a peak top molecular weight in gel permeation chromatography of a tetrahydrofuran-soluble matter of the polyester resin (A) is 2000 to 20000, and the polyester resin (A) has a softening point [Tm] of 120 to 170° C. measured by a flow tester.

5. The toner binder according to claim 1, wherein the crystalline resin (B) has a pencil hardness of 3B to 6H.

6. The toner binder according to claim 1, wherein the crystalline resin (B) comprises a urethane- or urea-modified polyester resin or a vinyl resin containing a linear alkyl group having 12 to 50 carbon atoms.

7. The toner binder according to claim 1, wherein the crystalline resin (B) is a block resin composed of a crystalline part (b) and a noncrystalline part (c), the (b) has a weight average molecular weight of 2000 to 80000, and the ratio of the (b) in the (B) is 50% by weight or more.

8. The toner binder according to claim 7, wherein the crystalline resin (B) is a resin in which the crystalline part (b) and the noncrystalline part (c) are linearly bound in the following form wherein n is 0.9 to 3.5:

$$(b)\{-(c)-(b)\}_n.$$

9. The toner binder according to claim 1, wherein an SP value difference (ΔSP value) between the polyester resin (A) and the crystalline resin (B) or, where the noncrystalline linear polyester resin (C) is contained, between the mixture of the (A) and the (C) and the crystalline resin (B) satisfies the following formula:

$$\Delta SP \text{ value} \geq 1.5(\text{cal/cm}^3)^{1/2} \qquad \text{formula (3).}$$

10. The toner binders according claim 1, wherein when a glass transition point (° C.) of the polyester resin (A) or, where the noncrystalline linear polyester resin (C) is contained, of the mixture of the (A) and the (C) is represented by (Tg1) and a glass transition point (° C.) of the mixture resulting from the addition of the crystalline resin (B) thereto is represented by (Tg2), (Tg1) and (Tg2) satisfy the following formula:

$$(Tg1)-(Tg2) \leq 3° \text{ C.} \qquad \text{formula (4).}$$

11. The toner binder according to claim 1, wherein a ratio [G"(Tb+30)/G"(Tb+70)] of the loss modulus G"(Tb+30) at (Tb+30)° C. to the loss modulus G"(Tb+70) at (Tb+70)° C. of the crystalline resin (B) is 0.05 to 50.

12. The toner binder according to claim 1, wherein a weight average molecular weight in gel permeation chromatography of a tetrahydrofuran soluble matter of the crystalline resin (B) is 5000 to 100000.

13. The toner binder according to claim 1, wherein a peak top molecular weight in gel permeation chromatography of a tetrahydrofuran-soluble matter of the noncrystalline linear polyester resin (C) is 1000 to 10000.

14. The toner binder according to claim 1, wherein the polyester resin (A) is a modified polyester resin (A1) having a urethane group and a urea group, the (A1) containing a polyisocyanate (i) as well as a polyamine (j) and/or water as constituent units.

15. The toner binder according to claim 1, wherein a content weight ratio [A/B/C] of the polyester resin (A), the crystalline resin (B), and the noncrystalline linear polyester resin (C) is (5 to 90)/(1 to 70)/(0 to 90).

16. A toner composition comprising the toner binder according to claim 1, a colorant, and, if necessary, one or more additives selected from among a release agent, a charge controlling agent, and a fluidizer.

* * * * *